US009883566B1

(12) United States Patent
Chen

(10) Patent No.: US 9,883,566 B1
(45) Date of Patent: Jan. 30, 2018

(54) CONTROL OF MODULAR LIGHTED ARTIFICIAL TREES

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 172 days.

(21) Appl. No.: 14/702,224

(22) Filed: May 1, 2015

Related U.S. Application Data

(60) Provisional application No. 61/987,160, filed on May 1, 2014.

(51) Int. Cl.

| | |
|---|---|
| ***H05B 37/02*** | (2006.01) |
| ***F21V 33/00*** | (2006.01) |
| ***F21V 23/06*** | (2006.01) |
| ***F21V 23/00*** | (2015.01) |
| ***F21S 4/00*** | (2016.01) |
| ***H05B 33/08*** | (2006.01) |

(Continued)

(52) U.S. Cl.
CPC ..... *H05B 37/0272* (2013.01); *A47G 33/06* (2013.01); *F21S 4/002* (2013.01); *F21V 23/001* (2013.01); *F21V 23/06* (2013.01); *F21V 33/0028* (2013.01); *H05B 33/0845* (2013.01); *H05B 33/0857* (2013.01); *F21W 2121/04* (2013.01)

(58) Field of Classification Search
CPC ..... H05B 37/0272; H05B 33/0845; H05B 33/0857; A47G 33/06; A47G 33/04; A47G 2033/0827; F21S 4/002; F21S 4/10; F21V 23/001; F21V 23/06; F21V 33/0028; F21V 23/003; F21W 2121/04
See application file for complete search history.

(56) References Cited

U.S. PATENT DOCUMENTS

| | | | |
|---|---|---|---|
| 377,953 | A | 2/1888 | Mills |
| 438,310 | A | 10/1890 | Edison |

(Continued)

FOREIGN PATENT DOCUMENTS

| | | | |
|---|---|---|---|
| CA | 1182513 | A | 2/1985 |
| CN | 2102058 | U | 4/1992 |

(Continued)

OTHER PUBLICATIONS

Holtek, "HT2040A Christmas Light Controller" (Mar. 26, 1997) 9 pgs.

(Continued)

*Primary Examiner* — Bao Q Truong
(74) *Attorney, Agent, or Firm* — Christensen, Fonder, Dardi & Herbert PLLC

(57) ABSTRACT

A lighting power and control system for an artificial lighted tree. The system includes: a first primary controller including a processor; a first plurality of sub-controllers, each including a processor, each of the first plurality of sub-controllers in electrical communication with the first primary controller; and a first plurality of lighting elements, each of the first plurality of lighting elements in direct electrical communication with one of the first plurality of sub-controllers. The first primary controller controls each of the first plurality of sub-controllers, and each of the first plurality of sub-controllers selectively powers the plurality of lighting elements according to commands issued by the primary controller.

20 Claims, 10 Drawing Sheets

(51) Int. Cl.
*A47G 33/06* (2006.01)
*F21W 121/04* (2006.01)

(56) References Cited

U.S. PATENT DOCUMENTS 735,010 A 7/1903 Zahl
860,406 A 7/1907 McGahan
1,314,008 A 8/1919 McWilliams
1,372,777 A 3/1921 Samuel et al.
1,495,695 A 5/1924 Karr
1,536,332 A 5/1925 Dam
1,590,220 A 6/1926 Wurts
1,694,974 A 12/1928 Glover
2,025,189 A 12/1935 Yanchenko
2,050,364 A 8/1936 Morton
2,072,337 A 3/1937 Kamm
2,112,281 A 3/1938 Ferris
2,186,351 A 1/1940 Stojaneck
2,188,529 A 1/1940 Corina
2,229,211 A 1/1941 Korengold
2,679,911 A 8/1948 Bhend
2,466,499 A 4/1949 Sokolik
2,484,596 A 10/1949 Waltz
2,533,374 A 12/1950 Hyland
2,563,713 A 8/1951 Frei et al.
2,570,751 A 10/1951 Benander
2,636,069 A 4/1953 Gilbert
2,782,296 A 2/1957 Walter
2,806,938 A 9/1957 Henry
2,857,506 A 10/1958 Minteer
2,863,037 A 12/1958 Johnstone
2,910,842 A 11/1959 Sensenig
2,932,811 A 4/1960 Abraham et al.
2,969,456 A 1/1961 Raymaley
2,973,546 A 3/1961 Roche
2,984,813 A 5/1961 Bossi
3,107,966 A 10/1963 Bonhomme
3,115,435 A 12/1963 Abramson
3,118,617 A 1/1964 Hellrich
3,120,351 A 2/1964 Kirsten
3,131,112 A 4/1964 Abramson
3,214,579 A 10/1965 Pacini
3,233,207 A 2/1966 Ahroni et al.
3,286,088 A 11/1966 Ahroni
3,296,430 A 1/1967 Eckert
3,345,482 A 10/1967 Lou
3,398,260 A 8/1968 Martens
3,409,867 A 11/1968 Lessner
3,470,527 A 9/1969 Bonhomme
3,504,169 A 3/1970 Freeburger
3,513,063 A 3/1970 Sloane
3,521,216 A 7/1970 Tolegian
3,522,579 A 8/1970 Matsuya
3,571,586 A 3/1971 Duckworth
3,574,102 A 4/1971 Hermanson
3,585,564 A 6/1971 Skjervoll
3,594,260 A 7/1971 Dieffenbach
3,603,780 A 9/1971 Lu
3,616,107 A 10/1971 Kershner
3,617,732 A 11/1971 Fisher
3,640,496 A 2/1972 Duncan
3,663,924 A 5/1972 Gerlat
3,704,366 A 11/1972 Korb et al.
3,715,708 A 2/1973 Lloyd et al.
3,728,787 A 4/1973 McDonough
3,748,488 A 7/1973 David, Jr.
3,764,862 A 10/1973 Jankowski
3,783,437 A 1/1974 Graff et al.
3,806,399 A 4/1974 Cocjin
3,808,450 A 4/1974 Davis, Jr.
3,812,380 A 5/1974 Davis, Jr.
3,819,457 A 6/1974 Mottel
3,819,459 A 6/1974 Wren
3,834,976 A 9/1974 Mottel
3,862,434 A 1/1975 Davis, Jr.
3,864,580 A 2/1975 Davis, Jr.
3,914,786 A 10/1975 Grossi
3,970,834 A 7/1976 Smith
3,971,619 A 7/1976 Rohrssen
3,985,924 A 10/1976 Pritza
4,012,631 A 3/1977 Creager
4,020,201 A 4/1977 Miller
4,045,868 A 9/1977 Ammon et al.
4,057,735 A 11/1977 Davis, Jr.
4,097,917 A 6/1978 McCaslin
4,109,345 A 8/1978 Sargent et al.
4,125,781 A 11/1978 Davis, Jr.
4,140,823 A 2/1979 Weskamp
4,153,860 A 5/1979 Vonick
4,161,768 A 7/1979 Gauthier et al.
4,215,277 A 7/1980 Weiner et al.
4,245,875 A 1/1981 Shaffer et al.
4,248,916 A 2/1981 Chase
4,273,814 A 6/1981 Koehler
4,291,075 A 9/1981 Puleo
4,305,980 A 12/1981 Koehler
4,340,841 A 7/1982 Schupp
4,343,842 A 8/1982 Chase
4,437,782 A 3/1984 Geisthoff
4,447,279 A 5/1984 Boisvert et al.
4,451,510 A 5/1984 Boisvert et al.
4,462,065 A 7/1984 Rhodes
4,493,523 A 1/1985 Leong et al.
4,496,615 A 1/1985 Huang
4,516,193 A 5/1985 Murphy
4,519,666 A 5/1985 Williams et al.
4,546,041 A 10/1985 Keane et al.
4,573,102 A 2/1986 Norwood
4,590,105 A 5/1986 Shaffer
4,620,270 A 10/1986 Laasko
4,631,650 A 12/1986 Ahroni
4,636,106 A 1/1987 Waisbrod
4,659,597 A 4/1987 Lau
4,662,775 A 5/1987 Faul
4,675,575 A 6/1987 Smith et al.
4,678,926 A 7/1987 Davis
4,712,299 A 12/1987 Loewen et al.
4,720,272 A 1/1988 Durand
4,727,449 A 2/1988 Fleck
4,753,600 A 6/1988 Williams
4,759,729 A 7/1988 Kemppainen et al.
4,769,579 A 9/1988 Jou
4,772,215 A 9/1988 Falk
4,774,113 A 9/1988 Shaffer
4,775,922 A 10/1988 Engel
4,777,573 A 10/1988 Liao
4,779,177 A 10/1988 Ahroni
4,789,570 A 12/1988 Maddock
4,799,902 A 1/1989 Laudig et al.
4,805,075 A 2/1989 Damore
4,807,098 A 2/1989 Ahroni
4,808,885 A 2/1989 Bausch et al.
4,855,880 A 8/1989 Mancusi, Jr.
4,859,205 A 8/1989 Fritz
4,867,690 A 9/1989 Thumma
4,870,547 A 9/1989 Crucefix
4,870,753 A 10/1989 Pfeffer et al.
4,890,000 A 12/1989 Chou
4,894,019 A 1/1990 Howard
4,899,266 A 2/1990 Ahroni
4,908,743 A 3/1990 Miller
4,921,426 A 5/1990 Kawasaki et al.
4,934,964 A 6/1990 Mazelle
5,015,510 A 5/1991 Smith
5,033,976 A 7/1991 Sarian et al.
5,051,877 A 9/1991 Liao
5,071,362 A 12/1991 Martens et al.
5,073,132 A 12/1991 Nottrott
5,088,669 A 2/1992 Zinnbauer
5,091,834 A 2/1992 Kao et al.
5,104,608 A 4/1992 Pickering
5,109,324 A 4/1992 Ahroni
5,121,310 A 6/1992 Ahroni
5,128,595 A 7/1992 Hara

(56) References Cited

U.S. PATENT DOCUMENTS 5,139,343 A 8/1992 Lin
5,149,282 A 9/1992 Donato et al.
5,154,508 A 10/1992 Ahroni
5,213,407 A 5/1993 Eisenbraun
5,217,382 A 6/1993 Sparks
5,218,233 A 6/1993 Takahashi
5,281,158 A 1/1994 Lin
5,300,864 A 4/1994 Allen, Jr.
5,334,025 A 8/1994 Föhl
5,342,661 A 8/1994 Wilcox, II
5,349,780 A 9/1994 Dyke
5,350,315 A 9/1994 Cheng et al.
5,366,386 A 11/1994 Liao
5,376,752 A 12/1994 Limeris et al.
5,380,215 A 1/1995 Huang
5,389,008 A 2/1995 Cheng et al.
5,390,463 A 2/1995 Sollner
D356,246 S 3/1995 Adams
5,409,403 A 4/1995 Falossi et al.
5,422,766 A 6/1995 Hack et al.
5,438,154 A 8/1995 Segan et al.
5,442,258 A 8/1995 Shibata
5,453,664 A 9/1995 Harris
5,455,750 A 10/1995 Davis et al.
5,456,620 A 10/1995 Kaminski
5,481,444 A 1/1996 Schulz
D367,257 S 2/1996 Buelow et al.
5,492,429 A 2/1996 Hodges
5,517,390 A 5/1996 Zins
5,518,425 A 5/1996 Tsai
5,536,538 A 7/1996 Hartung
5,541,818 A 7/1996 Ng et al.
5,550,720 A 8/1996 Carroll
5,559,681 A 9/1996 Duarte
5,560,975 A 10/1996 Casper
D375,483 S 11/1996 Tashiro
5,580,159 A 12/1996 Liu
5,586,905 A 12/1996 Marshall et al.
5,605,395 A 2/1997 Peng
5,607,328 A 3/1997 Joly
5,624,283 A 4/1997 Hotea
5,626,419 A 5/1997 Lin
5,629,587 A 5/1997 Gray et al.
5,639,157 A 6/1997 Yeh
5,652,032 A 7/1997 Kaczor et al.
5,653,616 A 8/1997 Hotea
5,695,279 A 12/1997 Sonnleitner et al.
5,702,262 A 12/1997 Brown et al.
5,702,268 A 12/1997 Lien et al.
5,707,136 A 1/1998 Byers
5,709,457 A 1/1998 Hara
5,712,002 A 1/1998 Reilly, III
5,720,544 A 2/1998 Shu
5,722,766 A 3/1998 Shu
5,727,872 A 3/1998 Liou
5,758,545 A 6/1998 Fevre et al.
5,759,062 A 6/1998 Chen
5,775,933 A 7/1998 Chen
5,776,559 A 7/1998 Woolford
5,776,599 A 7/1998 Haluska et al.
5,785,412 A 7/1998 Wu et al.
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,822,855 A 10/1998 Szczesny et al.
5,828,183 A 10/1998 Wang et al.
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,541 A 12/1998 Chou
5,855,705 A 1/1999 Gauthier
5,860,731 A 1/1999 Martinez
5,860,830 A 1/1999 Wu
5,869,151 A 2/1999 Chong
5,878,989 A 3/1999 Allman
5,893,634 A 4/1999 Wang
5,908,238 A 6/1999 Huang
5,921,806 A 7/1999 Shuey
5,934,793 A 8/1999 Rahman
5,937,496 A 8/1999 Benoit et al.
5,938,168 A 8/1999 Adams
5,957,723 A 9/1999 Gort-Barten
5,966,393 A 10/1999 Hide et al.
5,971,810 A 10/1999 Taylor
5,979,859 A 11/1999 Vartanov et al.
6,004,006 A 12/1999 Wang
6,007,362 A 12/1999 Davis et al.
6,030,670 A 2/2000 Chang
6,053,774 A 4/2000 Lin
6,056,427 A 5/2000 Kao
6,065,233 A 5/2000 Rink
6,079,848 A 6/2000 Ahroni
6,084,357 A 7/2000 Janning
6,086,395 A 7/2000 Lloyd et al.
6,091,204 A 7/2000 Chen
6,095,874 A 8/2000 Quaranta
6,099,920 A 8/2000 Kao
6,102,740 A 8/2000 Murakami et al.
6,111,201 A 8/2000 Drane et al.
6,113,430 A 9/2000 Wu
6,116,563 A 9/2000 Tsai
6,117,503 A 9/2000 Lee et al.
6,120,312 A 9/2000 Shu
6,123,433 A 9/2000 Chen
6,139,376 A 10/2000 Ooya et al.
6,147,367 A 11/2000 Yang et al.
6,149,448 A 11/2000 Haller et al.
6,155,697 A 12/2000 Ahroni
6,162,515 A 12/2000 Hill
6,203,169 B1 3/2001 Coushaine et al.
6,217,191 B1 4/2001 Wu et al.
6,217,199 B1 4/2001 Lo
6,228,442 B1 5/2001 Coco
6,241,559 B1 6/2001 Taylor
6,245,425 B1 6/2001 McCullough et al.
6,257,736 B1 7/2001 Fehrenbach
6,257,740 B1 7/2001 Gibboney, Jr.
6,257,793 B1 7/2001 Lin
6,261,119 B1 7/2001 Green
6,273,584 B1 8/2001 Wang et al.
6,276,120 B1 8/2001 Adriaensen et al.
6,283,797 B1 9/2001 Wu
6,285,140 B1 9/2001 Ruxton
6,292,901 B1 9/2001 Lys et al.
6,320,327 B1 11/2001 Lavatelli et al.
6,328,593 B1 12/2001 Chang et al.
6,347,965 B1 2/2002 Pan
D454,110 S 3/2002 Andre et al.
6,354,719 B1 3/2002 Pan
6,361,368 B1 3/2002 Tseng
6,363,607 B1 4/2002 Chen et al.
6,368,130 B1 4/2002 Fukuda
6,407,411 B1 6/2002 Wojnarowski et al.
6,452,317 B1 9/2002 Tseng
6,457,839 B1 10/2002 Grandoit
6,458,435 B1 10/2002 Lai
6,514,581 B1 2/2003 Gregory
6,533,437 B1 3/2003 Ahroni
6,541,800 B2 4/2003 Barnett et al.
6,544,070 B1 4/2003 Radliff
6,547,584 B2 4/2003 Myer et al.
6,571,340 B1 5/2003 Lee
6,576,844 B1 6/2003 Kamata
6,580,182 B2 6/2003 Janning
6,588,914 B1 7/2003 Tang
6,592,094 B1 7/2003 Kao
6,595,657 B1 7/2003 Shieh
D478,310 S 8/2003 Andre et al.

(56) References Cited

U.S. PATENT DOCUMENTS 6,609,814 B2 8/2003 Ahroni
6,623,291 B1 9/2003 Tsai
6,634,766 B1 10/2003 Gordon
6,641,417 B2 11/2003 Tanaka
6,644,836 B1 11/2003 Adams
6,653,797 B2 11/2003 Puleo, Sr. et al.
D483,721 S 12/2003 Kim et al.
6,666,734 B2 12/2003 Fukatsu
6,672,750 B1 1/2004 Kao
D486,385 S 2/2004 Smith-Kielland et al.
6,733,167 B1 5/2004 Kao
6,752,512 B2 6/2004 Pan
6,774,549 B2 8/2004 Tsai et al.
6,794,825 B1 9/2004 Kao
6,805,463 B2 10/2004 Shieh
6,824,293 B2 11/2004 Chang
6,830,358 B2 12/2004 Allen
6,840,655 B2 1/2005 Shen
6,840,802 B2 1/2005 Shepherd
6,866,394 B1 3/2005 Hutchins et al.
6,869,316 B2 3/2005 Hinkle et al.
6,883,951 B2 4/2005 Wu
6,884,083 B2 4/2005 Shepherd
6,908,215 B2 6/2005 Wu
6,929,383 B1 8/2005 Janning
D509,797 S 9/2005 Milan
6,942,355 B1 9/2005 Castiglia
6,951,405 B2 10/2005 Yao
6,957,971 B2 10/2005 Wu
6,962,498 B2 11/2005 Kohen
7,021,598 B2 4/2006 Kao
7,029,145 B2 4/2006 Frederick
7,045,965 B2 5/2006 Li et al.
7,052,156 B2 5/2006 Primeau
7,055,980 B2 6/2006 Wu
7,055,981 B2 6/2006 Yao
7,066,628 B2 6/2006 Allen
7,066,739 B2 6/2006 McLeish
7,108,514 B2 9/2006 Chen et al.
D530,277 S 10/2006 Lin
7,132,139 B2 11/2006 Yang
7,144,610 B1 12/2006 Estes et al.
7,145,105 B2 12/2006 Gaulard
7,147,518 B2 12/2006 Marechal et al.
7,186,050 B2 3/2007 Dean et al.
7,192,303 B2 3/2007 Kohen
7,204,720 B1 4/2007 Shiu
7,207,844 B2 4/2007 Peng
7,235,815 B2 6/2007 Wang
7,253,556 B1 8/2007 Gibboney
7,253,714 B1 8/2007 Tsui
7,264,392 B2 9/2007 Massabki et al.
7,270,450 B2 9/2007 Chan
7,311,566 B2 12/2007 Dent
7,315,692 B2 1/2008 Chow
7,318,744 B2 1/2008 Kuo
7,326,091 B2 2/2008 Nania et al.
7,371,115 B1 5/2008 Hsieh et al.
7,393,019 B2 7/2008 Taga et al.
7,422,489 B1 9/2008 Tseng
D580,355 S 11/2008 Hussaini et al.
7,445,824 B2 11/2008 Leung et al.
7,453,194 B1 11/2008 Gibboney
D582,846 S 12/2008 Lett
7,462,066 B2 12/2008 Kohen
D585,384 S 1/2009 Andre et al.
7,473,024 B2 1/2009 Gibboney
7,527,508 B1 5/2009 Lee et al.
7,554,266 B1 6/2009 Chen
D598,374 S 8/2009 Sasada
7,575,362 B1 8/2009 Hsu
7,581,870 B2 9/2009 Massabki et al.
7,585,187 B2 9/2009 Daily et al.
7,585,552 B2 9/2009 Meseke
7,609,006 B2 10/2009 Gibboney
D608,685 S 1/2010 Krize
7,652,210 B2 1/2010 White
D609,602 S 2/2010 Krize
D611,409 S 3/2010 Green et al.
7,695,298 B2 4/2010 Arndt et al.
7,893,627 B2 2/2011 Li
D638,355 S 5/2011 Chen
8,007,129 B2 8/2011 Yang
8,047,700 B2 11/2011 Massabki et al.
8,053,042 B1 11/2011 Loomis
8,062,718 B2 11/2011 Schooley
8,092,255 B2 1/2012 Wang
8,096,833 B2 1/2012 Tobey
8,100,546 B2 1/2012 Lutz et al.
8,113,889 B2 2/2012 Zhang et al.
8,132,360 B2 3/2012 Jin et al.
8,132,649 B2 3/2012 Rogers
8,203,275 B2 6/2012 Ruxton
8,235,737 B2 8/2012 Cheng et al.
8,298,633 B1 10/2012 Chen
8,348,466 B2 1/2013 Plumb et al.
D678,211 S 3/2013 Chen
8,390,306 B2 3/2013 Hamann et al.
8,450,950 B2 5/2013 McRae
8,454,186 B2 6/2013 Chen
8,454,187 B2 6/2013 Chen
8,469,734 B2 6/2013 Chen
8,469,750 B2 6/2013 Chen
D686,523 S 7/2013 Chen
8,491,323 B2 7/2013 Ishibashi
8,534,186 B2 9/2013 Glucksman et al.
8,562,175 B2 10/2013 Chen
8,568,015 B2 10/2013 Chen
8,569,960 B2 * 10/2013 Chen ..... A47G 33/06 315/185 R
8,573,548 B2 11/2013 Kuhn et al.
8,592,845 B2 11/2013 Chen
D696,153 S 12/2013 Chen
8,608,342 B2 12/2013 Chen
8,777,648 B2 7/2014 Kitajima et al.
8,853,721 B2 10/2014 Chen
8,863,416 B2 10/2014 Leung et al.
8,870,404 B1 10/2014 Chen
8,876,321 B2 11/2014 Chen
8,916,242 B2 12/2014 Fu et al.
8,959,810 B1 2/2015 Leung et al.
8,974,072 B2 3/2015 Chen
9,044,056 B2 6/2015 Chen
9,055,777 B2 6/2015 Chen
9,066,617 B2 6/2015 Chen
9,119,495 B2 9/2015 Leung et al.
9,140,438 B2 9/2015 Chen
9,157,587 B2 10/2015 Chen
9,157,588 B2 10/2015 Chen
9,179,793 B2 11/2015 Chen
9,220,361 B1 12/2015 Chen
9,222,656 B2 12/2015 Chen
9,243,788 B2 1/2016 Chen
9,402,498 B2 8/2016 McRae
9,439,528 B2 9/2016 Chen
9,441,800 B1 9/2016 Chen
9,441,823 B1 9/2016 Chen
9,526,286 B2 12/2016 Chen
9,572,446 B2 2/2017 Chen
9,593,831 B2 * 3/2017 Yu ..... F21V 23/06
9,648,919 B2 5/2017 Chen
9,617,074 B2 6/2017 Chen
9,677,748 B1 6/2017 Chen
9,677,749 B2 6/2017 Chen
9,700,169 B2 7/2017 Wong
2002/0002015 A1 1/2002 Mochizuki et al.
2002/0097573 A1 7/2002 Shen
2002/0109989 A1 8/2002 Chuang
2002/0118540 A1 8/2002 Ingrassia
2002/0149936 A1 10/2002 Mueller et al.
2003/0096542 A1 5/2003 Kojima
2003/0121781 A1 7/2003 Prohaska et al.
2003/0142494 A1 7/2003 Ahroni
2003/0198044 A1 10/2003 Lee

(56) References Cited

U.S. PATENT DOCUMENTS

| | | | |
|---|---|---|---|
| 2003/0198048 | A1 | 10/2003 | Frederick |
| 2003/0206412 | A1 | 11/2003 | Gordon |
| 2003/0218412 | A1 | 11/2003 | Shieh |
| 2003/0231779 | A1 | 12/2003 | Billington |
| 2004/0004435 | A1 | 1/2004 | Hsu |
| 2004/0012950 | A1 | 1/2004 | Pan |
| 2004/0080281 | A1 | 4/2004 | Pan |
| 2004/0090770 | A1 | 5/2004 | Primeau |
| 2004/0096596 | A1 | 5/2004 | Palmer, III et al. |
| 2004/0105270 | A1 | 6/2004 | Shieh |
| 2004/0115984 | A1 | 6/2004 | Rudy et al. |
| 2004/0145916 | A1 | 7/2004 | Wu |
| 2004/0161552 | A1 | 8/2004 | Butts, Jr. |
| 2004/0182597 | A1 | 9/2004 | Smith et al. |
| 2005/0048226 | A1 | 3/2005 | Gary et al. |
| 2005/0077525 | A1 | 4/2005 | Lynch et al. |
| 2005/0122723 | A1 | 6/2005 | Frederick |
| 2005/0239308 | A1 | 10/2005 | Cummings et al. |
| 2005/0249892 | A1 | 11/2005 | Rocheleau |
| 2005/0286267 | A1 | 12/2005 | Wang |
| 2006/0000634 | A1 | 1/2006 | Arakawa |
| 2006/0048397 | A1 | 3/2006 | King et al. |
| 2006/0146578 | A1 | 7/2006 | Kuo |
| 2006/0158138 | A1 | 7/2006 | Walter |
| 2006/0164834 | A1 | 7/2006 | Kao |
| 2006/0270250 | A1 | 11/2006 | Allen |
| 2006/0274556 | A1 | 12/2006 | Massabki et al. |
| 2007/0091606 | A1 | 4/2007 | Reed |
| 2007/0092664 | A1 | 4/2007 | Chun |
| 2007/0159109 | A1 | 7/2007 | Gibboney |
| 2007/0177402 | A1 | 8/2007 | Wu |
| 2007/0230174 | A1 | 10/2007 | Hicks et al. |
| 2007/0253191 | A1 | 11/2007 | Chin et al. |
| 2007/0273296 | A9 | 11/2007 | Janning |
| 2008/0007951 | A1 | 1/2008 | Chan |
| 2008/0025024 | A1 | 1/2008 | Yu |
| 2008/0107840 | A1 | 5/2008 | Leung et al. |
| 2008/0149791 | A1 | 6/2008 | Bradley |
| 2008/0186731 | A1 | 8/2008 | Graham |
| 2008/0186740 | A1 | 8/2008 | Huang et al. |
| 2008/0205020 | A1 | 8/2008 | Vich |
| 2008/0283717 | A1 | 11/2008 | Kim et al. |
| 2008/0296604 | A1 | 12/2008 | Chou et al. |
| 2008/0303446 | A1 | 12/2008 | Ding |
| 2008/0307646 | A1 | 12/2008 | Zaderej et al. |
| 2009/0002991 | A1 | 1/2009 | Huang |
| 2009/0003012 | A1 | 1/2009 | Hsu |
| 2009/0023315 | A1 | 1/2009 | Pfeiffer |
| 2009/0059578 | A1 | 3/2009 | Lau |
| 2009/0213620 | A1 | 8/2009 | Lee |
| 2009/0260852 | A1 | 10/2009 | Schaffer |
| 2009/0289560 | A1 | 11/2009 | Oliva |
| 2010/0000065 | A1 | 1/2010 | Cheng et al. |
| 2010/0053991 | A1 | 3/2010 | Boggs |
| 2010/0067242 | A1 | 3/2010 | Fung |
| 2010/0072747 | A1 | 3/2010 | Krize |
| 2010/0099287 | A1 | 4/2010 | Colburn et al. |
| 2010/0136808 | A1 | 6/2010 | Vanzo |
| 2010/0159713 | A1 | 6/2010 | Nishihira et al. |
| 2010/0195332 | A1 | 8/2010 | Wasem |
| 2010/0196628 | A1 | 8/2010 | Shooley |
| 2010/0263911 | A1 | 10/2010 | Watanabe |
| 2011/0062875 | A1 | 3/2011 | Altamura |
| 2011/0076425 | A1 | 3/2011 | Cheng et al. |
| 2011/0256750 | A1 | 10/2011 | Chen |
| 2012/0009360 | A1 | 1/2012 | Fu et al. |
| 2012/0076957 | A1 | 3/2012 | Chen |
| 2012/0098465 | A1 | 4/2012 | Rothschild |
| 2013/0093334 | A1 | 4/2013 | Lin et al. |
| 2013/0108808 | A1 | 5/2013 | Leung et al. |
| 2013/0119893 | A1 | 5/2013 | Chen |
| 2013/0120971 | A1 | 5/2013 | Chen |
| 2013/0163231 | A1 | 6/2013 | Chen |
| 2013/0301245 | A1 | 11/2013 | Chen |
| 2013/0301247 | A1 | 11/2013 | Chen |
| 2013/0308301 | A1 | 11/2013 | Chen |
| 2013/0309908 | A1 | 11/2013 | Sandoval et al. |
| 2014/0087094 | A1 | 3/2014 | Leung et al. |
| 2014/0215864 | A1 | 8/2014 | Fischer, Jr. et al. |
| 2014/0268689 | A1 | 9/2014 | Chen |
| 2014/0287618 | A1 | 9/2014 | Chen |
| 2014/0334134 | A1 | 11/2014 | Loomis |
| 2015/0029703 | A1 | 1/2015 | Chen |
| 2015/0070878 | A1 | 3/2015 | Yu |
| 2015/0157159 | A1 | 6/2015 | Leung et al. |
| 2015/0272250 | A1 | 10/2015 | Chen |
| 2016/0007430 | A1 | 1/2016 | Kidakarn |
| 2016/0021957 | A1 | 1/2016 | Chen |
| 2016/0021958 | A1 | 1/2016 | Chen |
| 2016/0033097 | A1 | 2/2016 | Chen |

FOREIGN PATENT DOCUMENTS

| | | | |
|---|---|---|---|
| CN | 2242654 | Y | 12/1996 |
| CN | 1181693 | | 5/1998 |
| CN | 2332290 | Y | 8/1999 |
| CN | 2484010 | Y | 4/2002 |
| CN | 1509670 | A | 7/2004 |
| CN | 2631782 | Y | 8/2004 |
| CN | 2751226 | Y | 1/2006 |
| CN | 100409504 | C | 9/2007 |
| CN | 100409506 | C | 8/2008 |
| CN | 201187701 | Y | 1/2009 |
| CN | 201829727 | U | 5/2011 |
| CN | 102224645 | A | 10/2011 |
| CN | 202473314 | U | 10/2012 |
| DE | 8436328 | | 4/1985 |
| DE | 10235081 | A1 | 2/2004 |
| EP | 434425 | A1 | 6/1991 |
| EP | 0552741 | | 7/1993 |
| EP | 0342050 | B1 | 8/1995 |
| EP | 0727842 | | 8/1996 |
| EP | 895742 | B1 | 2/1999 |
| EP | 0920826 | A1 | 6/1999 |
| EP | 1 049 206 | A2 | 11/2000 |
| EP | 1763115 | A2 | 3/2007 |
| EP | 2533374 | A1 | 12/2012 |
| FR | 1215214 | | 4/1960 |
| GB | 1150390 | | 4/1969 |
| GB | 1245214 | | 9/1971 |
| GB | 2112281 | A | 7/1983 |
| GB | 2137086 | A | 10/1984 |
| GB | 2 169 198 | A | 7/1986 |
| GB | 2172135 | A | 9/1986 |
| GB | 2178910 | A | 2/1987 |
| GB | 2208336 | A | 3/1989 |
| GB | 2221104 | A | 1/1990 |
| GB | 2396686 | A | 6/2004 |
| JP | H11121123 | A | 4/1999 |
| WO | WO 91/10093 | | 7/1991 |
| WO | WO 96/24966 | | 8/1996 |
| WO | WO 96/26661 | A1 | 9/1996 |
| WO | WO 2002/075862 | | 9/2002 |
| WO | WO 2004/008581 | A1 | 1/2004 |
| WO | WO 2007/140648 | A1 | 12/2007 |
| WO | WO 2009/115860 | A1 | 9/2009 |
| WO | WO 2010/082049 | A1 | 2/2010 |

OTHER PUBLICATIONS

Mosdesign Semiconductor Corp. "8 Functions Xmas Light Control" (May 14, 2002) (2 pgs.).

* cited by examiner

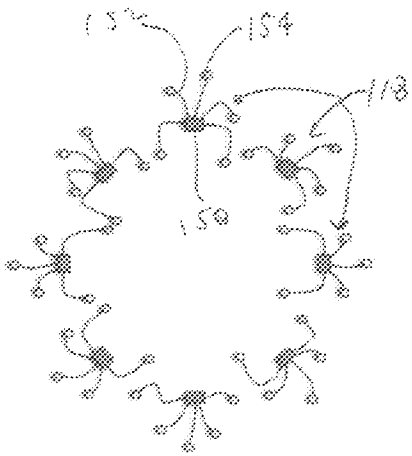
FIG. 13
FIG. 9
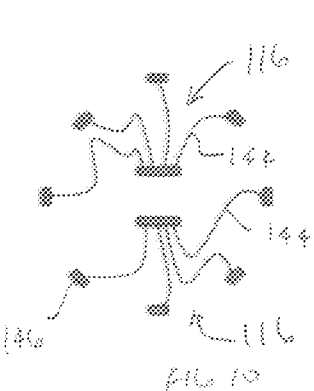
FIG. 10
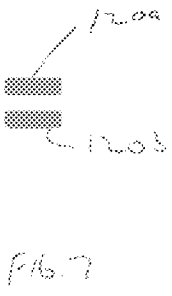
FIG. 7
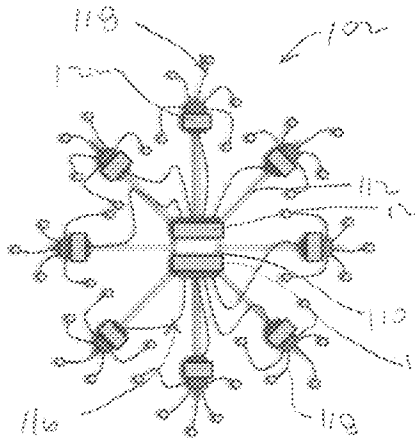
FIG. 6
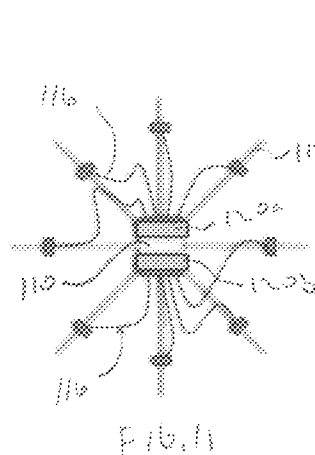
FIG. 11
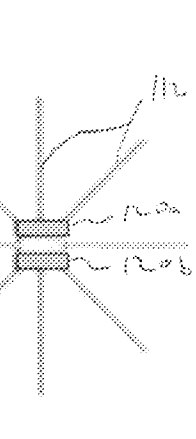
FIG. 8

100
102
104
106
108
110
112
114
116
118
120
122
124
126
128
130
132
134
136
138
140
142
144
146
148
150
152
154
156
158
160
162
164
166
168
170
172
174
176
178
180

CONTROL OF MODULAR LIGHTED ARTIFICIAL TREES

CROSS-REFERENCE TO RELATED APPLICATIONS

This application claims the benefit of Provisional Application No. 61/987,160, filed May 1, 2014, which is incorporated herein in its entirety by reference.

FIELD OF THE INVENTION

The present invention is generally directed to lighted artificial trees. More specifically, the present invention is directed to controlling electronic features, including lights, of lighted artificial trees having multiple tree and trunk sections.

BACKGROUND OF THE INVENTION

Artificial lighted trees often include decorative light strings distributed about the branches of the trees. Such decorative light strings may be of the traditional type having power plugs that may be connected to one another, and to an external power supply. Such well known configurations require that multiple power plugs of multiple light strings be plugged in, resulting in a web of wires wound about the branches of the tree.

Not only are such traditional systems tedious to assemble, but such systems provide limited control of the individual light strings and their lamps.

SUMMARY OF THE INVENTION

An embodiment of the invention includes a lighting power and control system for an artificial lighted tree, the system comprising: a first primary controller including a processor, a first plurality of sub-controllers, each including a processor, each of the first plurality of sub-controllers in electrical communication with the first primary controller; a first plurality of lighting elements, each of the first plurality of lighting elements in direct electrical communication with one of the first plurality of sub-controllers; wherein the first primary controller controls each of the first plurality of sub-controllers, and each of the first plurality of sub-controllers selectively powers the plurality of lighting elements according to commands issued by the primary controller.

Another embodiment comprises an artificial lighted tree for powering and controlling electrically powered lighting elements, the tree comprising a first tree portion and a second tree portion. The first tree portion includes: a first trunk portion; a first plurality of branches coupled to the first trunk portion; a first plurality of lighting elements distributed about the first plurality of branches; a first trunk electrical connector inserted at least partially into the first trunk portion and including at least three electrical terminals; a first set of power wires in electrical connection with the first trunk electrical connector and the primary controller; a first primary controller including a processor, the first primary controller in electrical connection with the first set of power wires and the first plurality of lighting elements, and in electrical connection with at least one of the three electrical terminals of the first trunk electrical connector. The second tree portion includes: a second trunk portion; a second plurality of branches coupled to the second trunk portion; a second plurality of lighting elements distributed about the second plurality of branches; and a second trunk electrical connector inserted at least partially into the second trunk portion and including at least three electrical terminals, the three electrical terminals configured to electrically connect to the three electrical terminals of the first trunk connector. The first tree portion is configured to couple to the second tree portion such that the first trunk electrical connector engages the second trunk electrical connector enabling power to be transmitted from the first tree portion to the second tree section, and enabling data from the primary controller to be transmitted to the second tree section.

Another embodiment comprises an artificial lighted tree for powering and controlling electrically powered lighting elements, the tree comprising a first tree portion and a second tree portion. The first tree portion includes: a first trunk portion; a first plurality of branches coupled to the first trunk portion; a first plurality of lighting elements distributed about the first plurality of branches; a first trunk electrical connector inserted at least partially into the first trunk portion and including at least three electrical terminals; a first set of power wires in electrical connection with the first trunk electrical connector. The second tree portion includes: a second trunk portion; a second plurality of branches coupled to the second trunk portion; a second plurality of lighting elements distributed about the second plurality of branches; and a first trunk electrical connector inserted at least partially into the second trunk portion and including at least three electrical terminals, the three electrical terminals configured to electrically connect to the at least three electrical terminals of the first trunk connector; a second trunk electrical connector inserted at least partially into the second trunk portion and including a plurality of electrical terminals, the second trunk electrical connector having fewer electrical terminals as compared to the first trunk electrical connector. The first tree portion is configured to couple to the second tree portion such that the first trunk electrical connector of the first tree portion engages the first trunk electrical connector of the second tree portion, thereby enabling power to be transmitted from the first tree portion to the second tree portion.

BRIEF DESCRIPTION OF THE FIGURES

The invention can be understood in consideration of the following detailed description of various embodiments of the invention in connection with the accompanying drawings, in which:

FIG. 6 depicts a two-controller control system mounted on a tree, according to an embodiment;

FIG. 8 depicts the pair of controllers of the tree section of FIG. 7 mounted to a tree, according to an embodiment;

FIG. 9 depicts secondary controllers distributed about the tree section of FIG. 6, according to an embodiment;

FIG. 10 depicts a wiring distribution layout of two primary wiring assemblies of the tree section of FIG. 6;

FIGS. 11 and 12 depict primary controllers and primary wiring assemblies mounted to a tree;

FIG. 13 depicts a distribution scheme for multiple lighting assemblies, according to an embodiment;

FIGS. 22-26 depict tree sections having a controller in a middle tree section, according to an embodiment.

Figure 1:
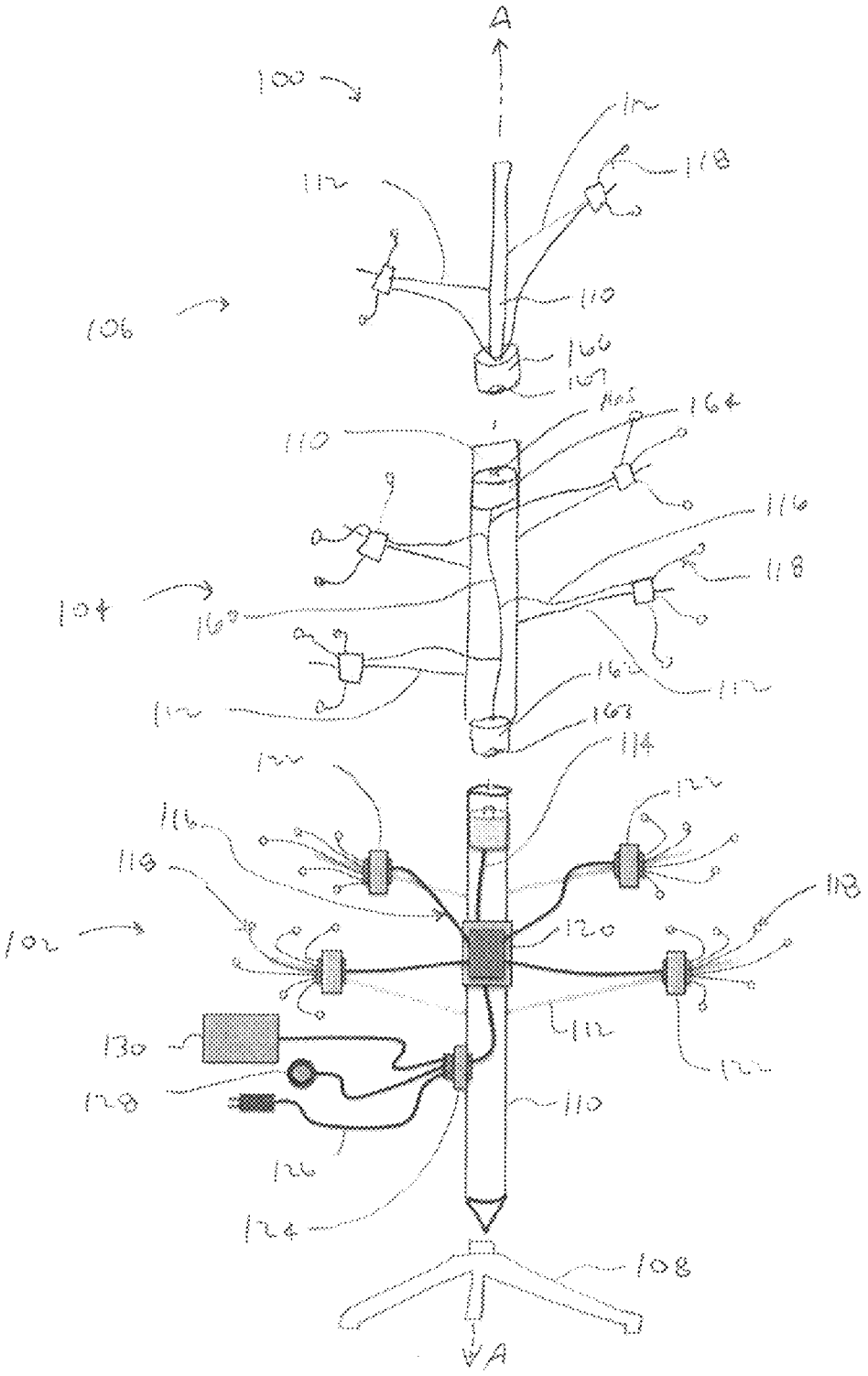
FIG. 1 is a front view of a controllable lighted artificial tree according to an embodiment.
Figures 2, 3, 4, 5:
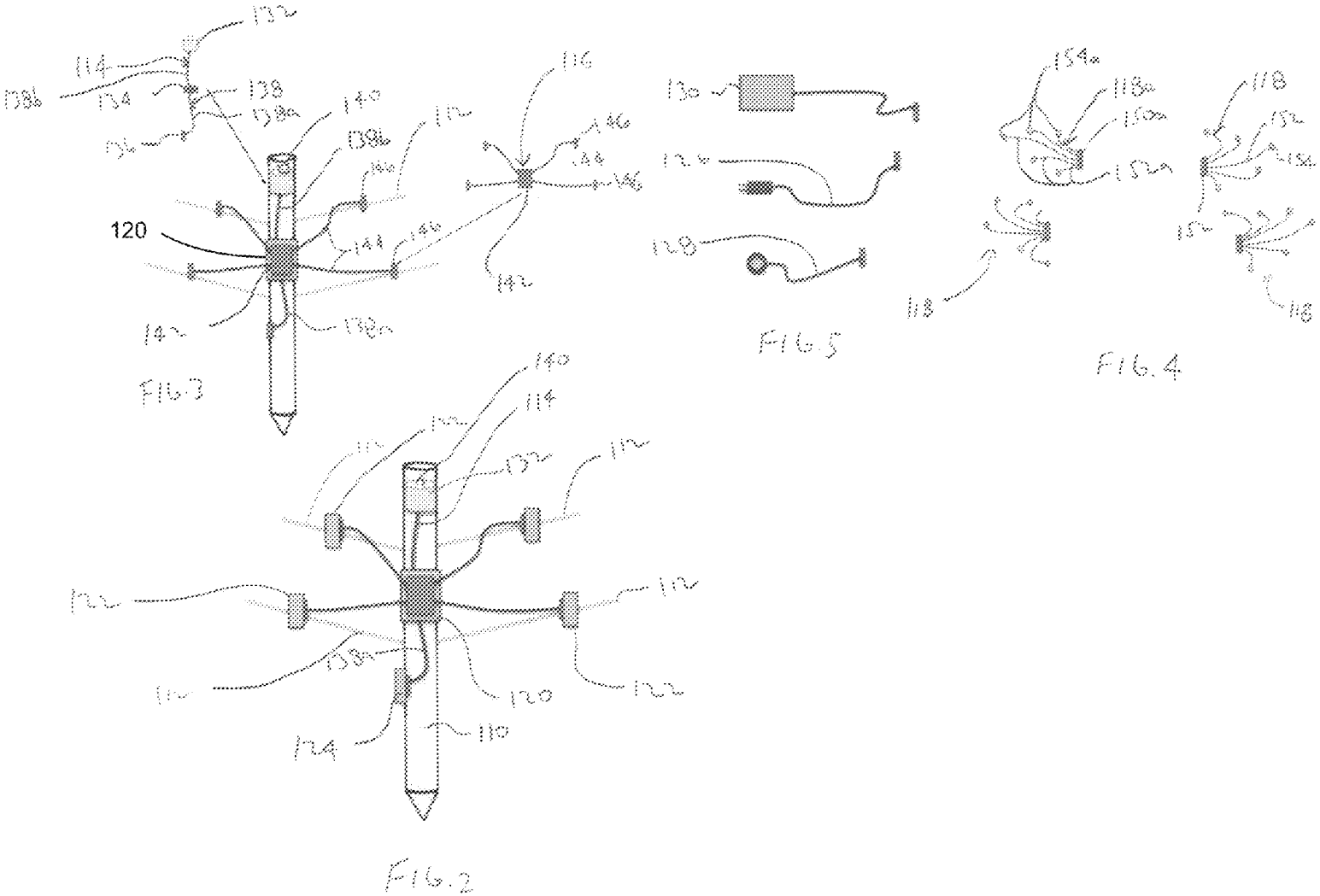
FIG. 2 is a front view of a first tree section of the tree of FIG. 1, according to an embodiment.
FIG. 3 is another view of the tree section of FIG. 2, with selected components shown.
FIG. 4 depicts lighting harness of the tree of FIG. 1, according to an embodiment.
FIG. 5 depicts optional control components of the tree of FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, an embodiment of controllable lighted artificial tree 100 is depicted. Tree 100 includes multiple tree sections, which as depicted, includes first section 102, second section 104 and third section 106. As depicted, first tree section 102 comprises a lower section tree, second tree section 104 comprises a middle section, and third tree section 106 comprises an upper tree section. Although three tree sections are depicted, it will be understood that lighted artificial tree 100 may comprise more or fewer tree sections, such as one section, two sections, four sections, and so on.

In an embodiment, tree 100 may also include tree stand 108 configured to support tree 100 in an upright position along vertical Axis A.

As will be described further below, each tree section joins to one or more adjacent tree sections both mechanically and electrically along Axis A to form completed tree 100. As will also be described further below, lights of tree 100 may be controlled by a master or primary controller, and in some cases, also controlled by multiple sub-controllers to create various lighting effects. Embodiments of the invention include efficient wiring layouts and assemblies or harnesses that facilitate modular construction of tree 100 as well as extensive control over individual tree lights.

Referring also to FIGS. 2-5, in an embodiment, tree section 102 includes trunk portion 110, branches 112 coupled to trunk 110, trunk wiring assembly 114, one or more primary wiring assemblies 116, a plurality of lighting wiring assemblies 118, one or more primary controllers 120, a plurality of secondary controllers 122, power interface portion 124, and power cord 126. In an embodiment, and as depicted, tree 100 may also include control switch 128 and wireless receiver 130.

For the sake of illustration, in FIGS. 1-5, wiring assemblies are simplified such that wire connections are depicted as a single line connecting two elements, though it will be understood that such wire connections may comprise two, three, four, or more conductors or wires for conducting power and/or data.

Trunk portion 110 may comprise a generally hollow, cylindrical structure as depicted, though in other embodiments, trunk portion 110 may be generally solid, with cavities for receiving portions of wiring and componentry. One end of trunk portion 110 may be narrower than another end of trunk portion 110 so as to be inserted into a trunk portion of an adjacent tree section; alternatively, an end of trunk portion 110 may receive a narrower end of a trunk portion of an adjacent tree section.

Branches 112 are connected or coupled to trunk portion 110. In an embodiment, branches 112 are pivotally connected to trunk portion 110 about a hinge or other pivot point. In an embodiment, light strings, light sets, and light elements are distributed upon an exterior of branches 112, as will be described further below.

Trunk wiring assembly 114, in an embodiment, comprises trunk electrical connector 132, controller connector 134, junction connector 136, and trunk wire set 138. In an embodiment, trunk wire set 138 may comprise a plurality of wires or conductors. In one such embodiment, trunk wire set 138 includes wire set **138*a* connecting junction connector 136 to controller connector 134 and wire set 138*b* connecting controller connector 134 to trunk electrical connector 132. In an embodiment, each of wire set 138*a* and 138*b* comprise two or more electrical conductors. In one such embodiment, each wire set 138*a* and 138*b* comprise a ground conductor and a power conductor. In an embodiment, each wire set 138*a* and 138*b*** also comprises one or more conductors for transmitting communication data.

In an embodiment, trunk wiring assembly 114 is located substantially entirely within a cavity formed by trunk portion 110. In another embodiment, portions of trunk wiring assembly 114 may be located outside trunk portion 110, such as portions of trunk electrical connector 132, which may extend partially outside an end of trunk portion 110, a portion of control connector 134 which may extend through an opening of trunk portion 110 to connect to controller 120, and so on.

Trunk electrical connector 132 includes electrical terminal set 140, electrically connected to trunk wire assembly 138. Trunk electrical connector 132 and its terminal set 140 are configured to couple to a corresponding trunk electrical connector and terminal set of second tree section 104, thereby electrically connecting tree section 102 and 104, and their respective trunk wiring assemblies.

Controller connector 134 comprises an electrical connector with conductive terminals electrically connected to trunk wire set **138*b*. Controller connector 134 couples to controller 120 to electrically connect wire set 138*b* and trunk electrical connector 132 to controller 134. In an embodiment, controller connector 134 connects to controller 120 within an interior of trunk portion 110**.

Junction connector 136, comprises an electrical connector with conductive terminals electrically connected to trunk wire set **138*a*. Junction connector 136 couples to power interface portion 124 to make an electrical connection between wire set 138*a* and power interface portion 124, thereby also electrically connecting power interface portion 124 to controller 120**.

Primary wiring assembly 116 includes central connector or interface 142, a plurality of wire sets 144, and a plurality of secondary controller connectors 144. In an embodiment, primary wiring assembly 116 is substantially on an exterior portion of tree section 102. Interface 142 is configured to interface or connect to primary controller 120 to electrically connect connector wire sets 144 and their respective connectors 146 to primary controller 120. Wire sets 144 may comprise a pair of conductors, such as first and second power transmission conductors, and may also include additional data transmission wires. Connectors 146 are configured to electrically connect wire sets 144 to subcontrollers or secondary controllers 122, and thereby electrically and communicatively connect primary controller 120 with secondary controllers 122.

In an embodiment, primary wiring assembly 116 couples to master controller 120 and may couple directly or indirectly to trunk portion 110. Connectors 146 may couple directly or indirectly to branches 112.

In an embodiment, tree section 102 includes a single primary wiring assembly 116. In an alternate embodiment, as depicted in FIGS. 6-13, tree section 102 may include more than one primary wiring assembly 116.

Referring still to FIGS. 1-5, tree 100 and tree section 102 includes a plurality of lighting wire assemblies 118. In an embodiment, each lighting wiring assembly 118 includes connector 150, lighting wire set 152 and lighting element 154.

Connectors 150 electrically and mechanically connect lighting wire sets 152 to respective connectors 146 of primary wiring assembly 116. In an embodiment, each connector 146 electrically connects multiple wire sets 152 such that all light elements 154 are electrically connected. In one such embodiment, all light elements 154 receive the same electrical signal from a secondary controller 122. In one such embodiment, all light elements 154 for a lighting wire assembly 118 would be powered on and off at the same time. In another such embodiment, although a common signal is received, light elements 154 receive a communication signal that selectively turns individual light elements 154 on and off in a predetermined manner.

Lighting wire sets 152 may include a plurality of conductors, such as a pair of power conducting wires and in some embodiments, additional conductors dedicated to communicating data from secondary controller 122 and/or primary controller 120.

Light elements 154 may comprise any of a variety of lights or lamps, such as incandescent bulbs, light-emitting diodes, and so on. Light elements 154 may also include light or lamp holders for connecting lamps to wire sets. In an embodiment, the lamp holders may comprise a housing and conductive terminals, and in some embodiments, a lens cover.

As will be described further below with respect to FIGS. 6-13, lighting wire assemblies 118 may be distributed about branches 112.

In an embodiment, primary controller 120 comprises may include a housing, PC board and in some embodiments, a selector switch. PC board 140 may include power conditioning electronics, including a voltage regulator and so on, a controller such as a microcontroller, microprocessor, processor, or similar, as well as memory, and other control electronics. A selector switch, such as a switch integral to controller 120, or an external switch, such as switch 128, may be in communication with the PC board and controller may comprise a rotary, pushbutton, or similar switch operable by a user.

In an embodiment, tree 100 and tree section 102 comprise a single primary controller 120. In another embodiment, tree 100 and tree section 102 comprise a pair of primary controllers, or even multiple primary controllers 120. In one such embodiment, tree section 102 includes two primary controllers 120; in an embodiment the two controllers are in communication with each other; in an embodiment, one of the two controllers controls the other controller, serving as a master controller or master primary controller.

In an embodiment, tree 100 and tree section 102 may include a plurality of secondary controllers 122, as depicted. In an alternate embodiment, tree 100 and tree section 102 does not include any secondary controllers 122, but rather, controls light elements 154 via one or more primary controllers 120, one of which may be a master controller. Secondary controllers 122 may include power conditioning electronics, a controller such as a microcontroller, microprocessor, or similar, memory, and other control electronics. In an embodiment including power conditioning electronics, secondary controllers 122 include voltage regulators for regulating and adjusting voltage delivered to light elements 154.

As will be discussed further below, primary controller 120 and/or secondary controllers 122 may include software programs having stored algorithms for controlling light elements 154 of tree 100. In an embodiment, groups of light elements 154 corresponding to individual lighting assemblies 118 are controlled separately by group. In another embodiment, each light element 154 may be controlled individually to create various lighting effects.

Power interface portion 124 may comprise a junction box, panel, or other mechanical and electrical interface. In an embodiment power interface portion 124 is mounted to, or otherwise coupled to, trunk portion 110. In other embodiments, power interface portion 124 may not be coupled to trunk portion 110; in one such embodiment, power interface portion 124 may be connected.

In an embodiment, power interface portion 124 comprises a housing and conductive terminals, and is configured to receive a conductive end of power cord 126, and optional components such as control switch 128 and wireless receiver 130. Power interface portion 124 may also be configured to receive audio input from an external source, via a wired or wireless connection. In one such embodiment, power interface portion 124 includes audio jacks for receiving a cord from device transmitting an audio data signal, the signal being transmitted to controller 120.

Power interface portion 124 is in electrical communication with primary controller 120 via wire set 138*a*.

In an embodiment, power cord 126 includes a pair of conductors, and is configured to transmit or conduct power received from an external power source. In an embodiment, power cord 126 directly transmits power received to master controller 120 or other portions of tree 100. In one such embodiment, power cord 126 is configured to transmit alternating-current (AC) power, and as such, may have limited or no power conditioning circuitry. In an alternate embodiment, power cord 126 may include power-conditioning or transforming circuitry for transforming an incoming power from the external power source to an outgoing power for use by tree 100. In one such embodiment, power cord 126 transforms incoming AC power to outgoing direct-current (DC) power.

In an embodiment, tree 100 includes control switch 128. Control switch 128 may comprise a foot-pedal activated switch as depicted, or in other embodiments, may comprise other switch configurations and components. Control switch 128 may be modular in nature, and in some cases, removably attached to power interface portion 124, thereby communicatively coupling control switch 128 to tree 100, and in some embodiments, to primary controller 120. In an embodiment, control switch 128 may be used to turn power on and off, or may be used to select various functions of tree 100, such as light display functions, musical functions, combinations thereof, and other functions relating to lights, sound and possibly movement.

Wireless receiver 130, in an embodiment, may be modular in nature, and in some cases removably, or otherwise attached to power interface portion 124. In an embodiment, wireless receiver 130 includes wiring 160, connector 162, and receiver portion 164. In an embodiment, wiring 160 defines a length of wiring that allows receiver portion 164 to be placed in a position for maximum reception, such as at a branch end away from trunk portion 110, or near a top or bottom portion of tree 100, unobstructed from branches, or some other convenient location.

Wireless receiver 130 may comprise a receiver or transceiver, and may be configured to operate over any of a number of known wireless networks using known wireless protocols, including radio-frequency, infrared, Bluetooth, Wi-Fi, Z-Wave, ZigBee, and so on. In an embodiment, wireless receiver 130 is configured to receive a wireless signal from an external remote control device, such as a smartphone or other remote controller, and to transmit the received signal, including data, to primary controller 120.

Referring to FIGS. 6-13, top plan views of tree section 102 and its wiring assemblies are depicted.

Referring specifically to FIG. 6, a top plan of tree section 102 is depicted. In this embodiment, tree section 102 includes two primary controllers 120. In an embodiment, the two primary controllers 120 are in communication with one another; in one such embodiment, one of the two controllers 120 controls the other controller, serving as a master controller.

As depicted, the wiring layout for tree section 102 is particularly efficient. In this embodiment, a wiring system for tree section 102 is split into two primary wiring assemblies 116, each communicatively coupled to a primary controller 120, such that approximately half of light elements 154 are controlled by one controller 120, and the other half controlled by the other controller. In an embodiment, tree 100 comprises only one true master primary controller 120, such that a second primary controller 120 is actually a sub-controller 120*b* under the control of master primary controller 120*a*. In such an embodiment, there are three levels of controllers: master primary controller 120*a*, one or more primary controllers 120*b*, and multiple secondary controllers 122, for a multi-tiered control system.

In an embodiment, each primary wiring assembly is communicatively coupled to multiple secondary controllers 122 and associated multiple lighting assemblies 118.

In an embodiment, each branch has one lighting assembly 118 and one secondary controller; in other embodiments, lighting assemblies 118 may be associated with more than one branch 112, or one branch may have more than one lighting assembly 118.

Because multiple light elements 154 of a light assembly 118 are controlled by, or communicate through, a primary wire set 144, the number of wires needed to attach a primary controller 120 is minimized. If each light element 154 were to have its own wires connecting to a master controller 120, the amount of wiring in tree section 102 would be vastly increased, and much more complicated.

Figure 7J:
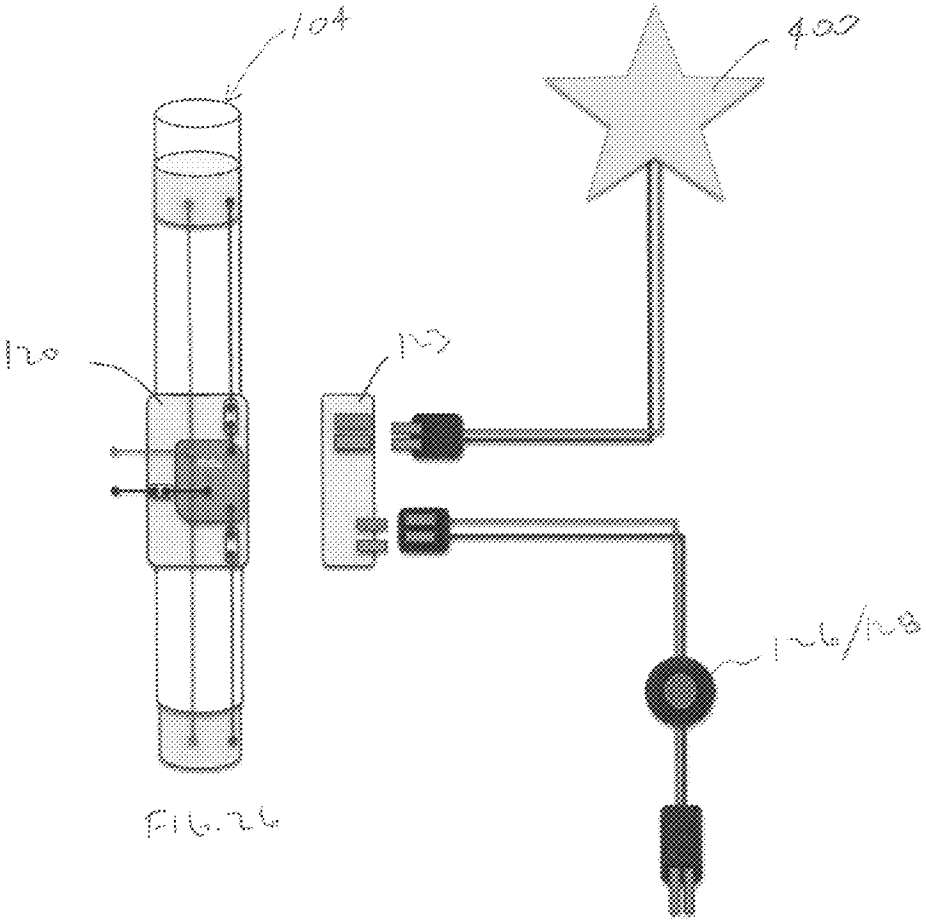
FIG. 7 depicts a pair of controllers of the tree section of FIG. 6.

Referring to FIGS. 7 and 8, a pair of master controllers 120 are depicted, one on each side of tree section 102.

Referring to FIG. 9, secondary controllers 122 are distributed about tree section 102. In an embodiment, secondary controllers 122 are distributed approximately equidistantly from one another. In an embodiment, secondary controllers 122 are located at approximately the same height relative to the ground upon which tree 100 is placed; in another embodiment, secondary controllers 122 are located at different heights of tree section 102 so as to be mounted on branches of different heights.

FIG. 10 depicts a wiring distribution layout or configuration of two primary wiring assemblies 116. As depicted, each primary wiring assembly 116 is positioned so as to allow each wire set 144 to be attached to, placed adjacent to, or near, one or more branches 112.

FIGS. 11 and 12 further depict primary controllers 120 and primary wiring assemblies 116 attached to trunk portion 110 and branches 112.

FIG. 13 depicts an embodiment of a distribution scheme for multiple lighting assemblies 118.

Referring again to FIGS. 1-3, in an embodiment, a master controller 120 is placed on trunk portion 110 at a location above a first set of branches 112 at a first height, and below a second set of branches 112 at a second height, such that some wires 144 are positioned above connector 142, and some below.

Figure 14:
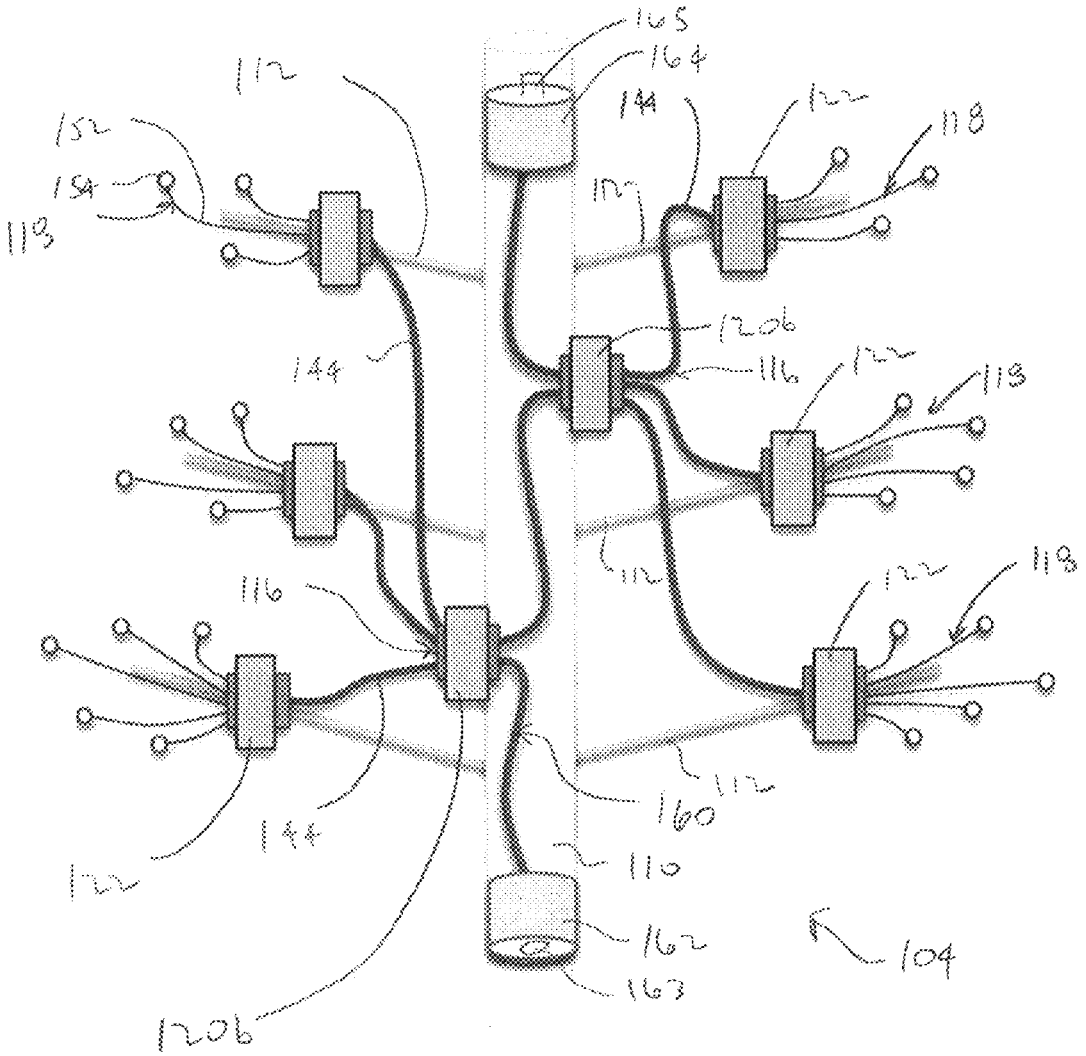
FIG. 14 depicts an embodiment of a tree section with a power interface portion, according to an embodiment.

Referring to FIG. 14, an embodiment of tree section 104 is depicted. Tree section 104, in an embodiment, includes many of the components of tree section 102, with the exception of power interface portion 124. Tree section 104 also includes a somewhat different trunk wiring assembly 160, as compared to trunk wiring assembly 114.

In this embodiment, trunk wiring assembly 160 includes first trunk electrical connector 162 with electrical terminals 163 and second trunk electrical connector 164 with electrical terminals 165. In an embodiment, trunk electrical connector 164 configured to mechanically and electrically connect to trunk electrical connector 132. In an embodiment trunk electrical connector 162 is similar to trunk electrical connector 132, but is configured to connect to trunk electrical connector 164 when tree section 102 is coupled to tree section 104 along trunk portion 100 and Axis A, such that the electrical terminals 140 and 163 make electrical connection, thereby electrically connecting trunk wiring assembly 114 to trunk wiring assembly 160.

When tree section 104 is coupled to tree section 102, power and in some cases, communication data, is transferred through trunk electrical connector 160 to primary controllers 120, and to trunk electrical connector 164 and its electrical terminals 165.

Referring again to FIG. 1, tree section 106 is configured to couple to tree section 104, such that trunk electrical connector 166 connects to trunk electrical connector 164, such that terminals 165 are in electrical connection with terminals 166.

When tree section 102 is coupled to tree section 104, and tree section 106 is coupled to tree section 104, power is transmitted throughout tree 100 to all three sections. In an embodiment, data relating to the control of light elements 154 is also transmitted throughout tree 100. In an embodiment, separate data is not transmitted to light elements 154, though light elements 154 may be turned on and off by transmitting or interrupting power to light elements 154.

In an embodiment, tree section 104 includes two primary controllers 120*b*, which may be subcontrollers controlled by master controller 120*b* of tree section 102.

Once assembled, in operation, light elements 154 may be controlled in groups or individually by a combination of primary controllers 120 commanding secondary controllers 122 to selectively turn light elements 154 on and off, or to control other functions of light elements 154. In an embodiment, selected light elements may be controlled to randomly turn on and off to create a twinkling effect; voltage to selected light elements 154 may be controlled, such as by ramping up or down, to create a "fade" effect, wherein the brightness of light element 154 is varied. Other visual effects may be created as each light element 154, or group of light elements of lighting assembly 118, is controlled.

In an embodiment, light elements 154 may comprise one or more LEDs. In one such embodiment, each light element 154 includes multiple LEDs, such as one red, one green, and one blue, or an RGB diode set. In an embodiment, primary controller 120 and/or secondary controller 122 may control such a light element 154 to create a variety of color combinations. If all light elements 154 comprise such RGB diode sets, then an entire tree can be made to change color.

When light elements 154 are wired and controlled individually, no mechanical or electrical bypass shunts or mechanisms are needed to keep other light elements 154 from losing power in the case of a single bulb being defective.

As described above, control of light elements 154 is accomplished by a "tiered" set of controllers, with one master primary controller 120 controlling one or more subcontrol primary controllers 120, and each subcontrol primary controller controlling multiple secondary controllers 122. Each secondary controller 122 controls a group of light elements, either collectively, in sub groups, or individually, to create nearly any lighting effect.

In an embodiment, a master controller, such as controller 120*a* provides commands to subcontrollers 120*b*, which each command a plurality of secondary controllers 122. In an embodiment, each light element 154 is associated with a data address for further control of individual light elements 154. In other embodiments, no such address is required.

The algorithms and software for such lighting effects may be pre-programmed into any of the controllers, and/or may be received by wireless receiver 130 via a remote control device. The remote control device may be used to transmit such programming to tree 100 wirelessly. In an embodiment, a remote control device may comprise any type of computer for creating and/or transmitting light control programs to tree 100.

In addition to light-control programming, tree 100 may also include audible or musical programming. In an embodiment tree 100 includes a speaker, which may be in wired or wireless communication with tree 100 and in some embodiments, master controller 120.

Consequently, tree 100 of FIGS. 1-14 includes multiple controllers and an efficient wiring distribution system for creating a wide variety of visual and audible displays. 124

Figure 15:
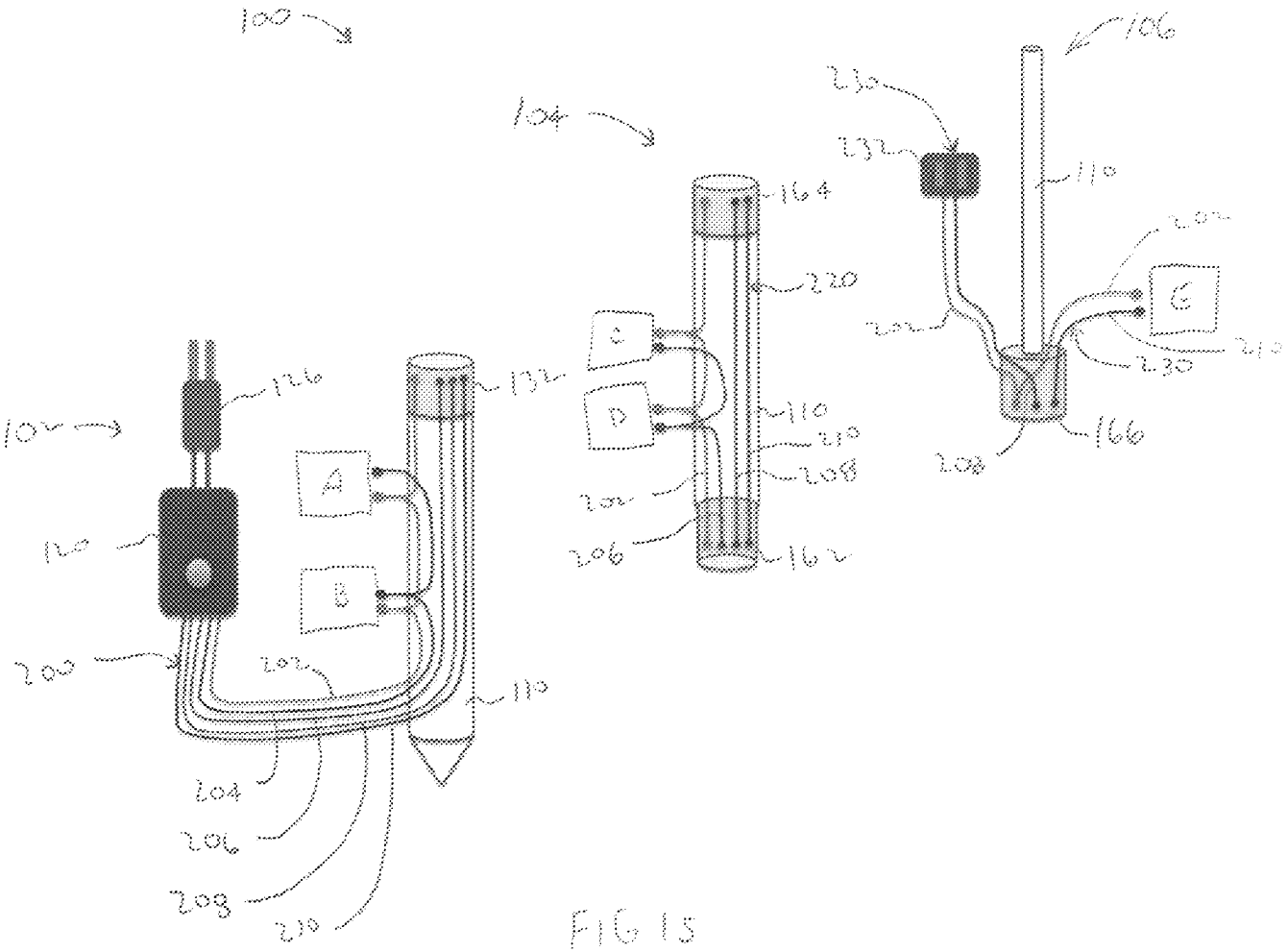
FIG. 15 depicts a single-controller tree configured for 3-way lighting control, according to an embodiment.
Figures 16, 17:
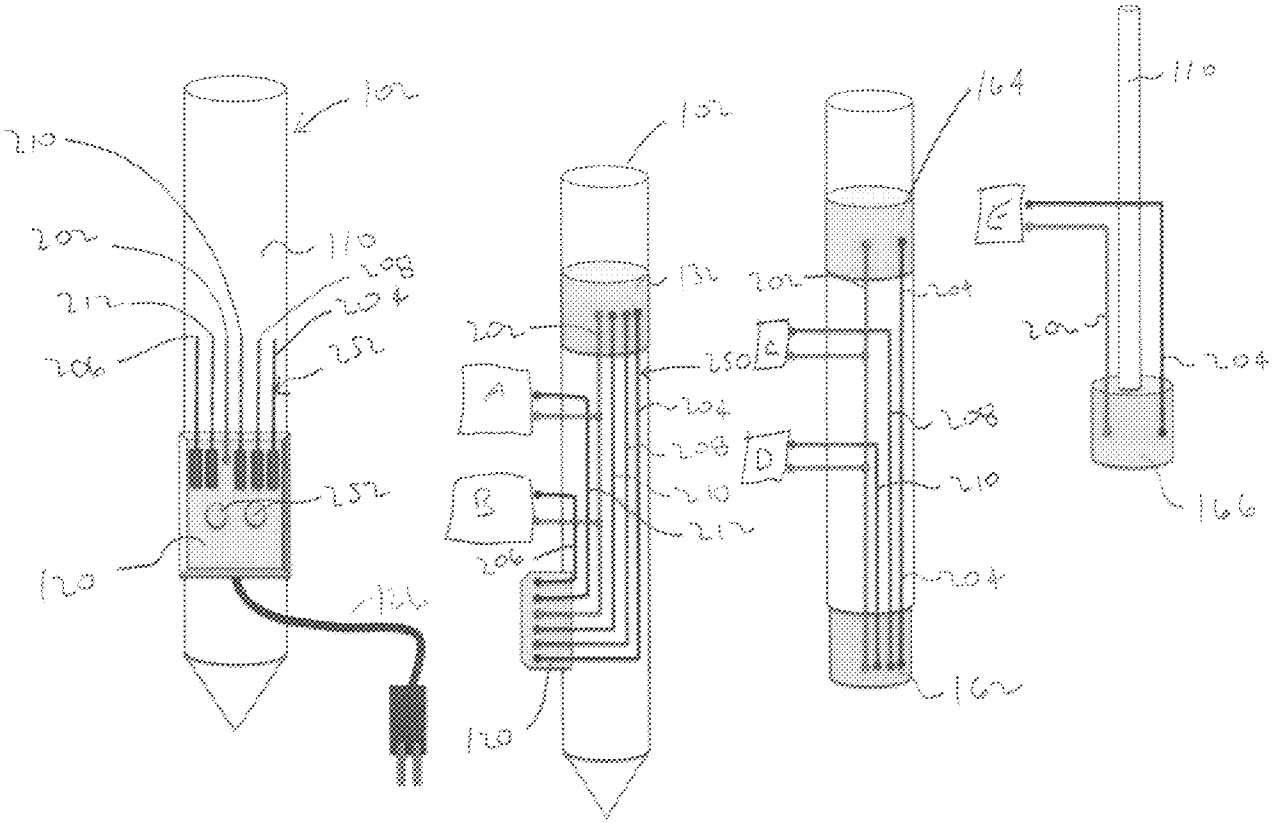
FIGS. 16-17 depict a single-controller tree section configured for 5-way lighting control, according to embodiments.

Referring to FIGS. 15-17, single controller embodiments of tree 100 are depicted.

Referring specifically to FIG. 15, single-controller embodiments of tree sections 102, 104, and 106 configured for "3-way" control of light elements, and with an accessory power plug, are depicted. "3-way" control means independent electrical control over three groups, sets, or items, such as three groups of light elements 154, or three groups of light assemblies 118, or three groups, each group consisting of multiple sets of light assemblies 118, such that power to a first group can be manipulated independent of how either of the other two groups are powered or manipulated. In this embodiment, power is transmitted throughout all three tree sections 102, 104, and 106. Further, each individual tree section is powerable separately from the other tree sections. In other words, power to light elements of tree section 102 may be controlled exclusive of power to light elements of tree sections 104 and 106. Similarly, light elements of tree sections 104 and 106 may be controlled independent of the other tree sections. The unique combination of controller, wiring scheme, and trunk electrical connectors enable such features.

In an embodiment, first tree section 102 includes power plug 126, which may be configured for AC or DC operation, controller 120, trunk portion 110, trunk electrical connector 132, wire set 200, light set A and light set B.

Wire set 200, in an embodiment comprises conductors 202, 204, 206, 208, and 210 extending within trunk portion 110. In an embodiment, conductor 202 may comprise a set of conductors, which may comprise a first power polarity, such as ground or neutral. Conductor 202 may be common to all light elements of tree 100 and any other electronic devices of tree 100.

In an embodiment, conductors 204, 206, 208, and 210 each transmit a power signal. As depicted, conductor 204 is electrically connected to light sets A and B, such that together, conductor 202 and 204 provide power to light sets A and B.

Conductors 206, 208, and 210 extend to trunk electrical connector 132, as does conductor 202, such that trunk electrical connector 132 comprises a 4-pin connector, which in an embodiment, includes a common ground/neutral/negative terminal, and three separately controllable power/live/positive terminals.

Light sets A and B are depicted in block form, and are understood to comprise any variety of light elements 154 as described above; the light elements 154 being connected electrically in any configuration, including in series, parallel, parallel-series, and series-parallel.

In such an embodiment, individual light elements 154 are not individually controllable, though light elements 154 of independent tree sections are controllable as a group.

Tree section 104 includes a trunk portion 110, electrical connector 162, wire set 220, trunk electrical connector 162, trunk electrical connector 164 and light sets C and D. Wire set 220 comprises conductors 202, 206, 208, and 210. Light sets C and D are electrically connected to conductors 202 and 206, which transmit power to light elements of the light sets.

Trunk electrical connector 162 is a 4-terminal connector configured to electrically connect to 4-pin trunk electrical connector 132.

Conductors 202, 208, and 210 extend within trunk portion 110 to trunk electrical connector 164.

Light sets C and D are controlled by controller 120 which selectively powers light sets C and D together via selective powering of conductor 206.

Tree section 106 includes a trunk portion 110, which may be narrower than trunk portions 110 of tree sections 102 and 104, trunk electrical connector 166, wire set 222, light set E, and accessory power plug assembly 230.

Wire set 222, in an embodiment, comprises conductors 202, 208, and 210.

Trunk electrical connector 166, in an embodiment, comprises a 3-terminal, or 3-pin, electrical connector.

Conductors 202 and 210 provide power to light set E, while conductors 202 and 208 provide power to accessory power plug 230.

Accessory power plug assembly 230 provides power to accessory items like tree top ornaments, musical ornaments, and so on. In an embodiment assembly 230 provides power that is different than the power provided to light sets A-E; in an embodiment assembly 230 provides power that is the same as the power provided to light sets A-E. Conductors 202 and 208 may comprise a length sufficient to locate the plug end 232 of assembly 230 a predetermined distance from trunk portion 110. In an embodiment, conductors 202 and 208 may each extend 0.5 ft to 2 ft from trunk portion 110, providing sufficient length to be connected to a powered accessory. In an embodiment, conductors 202 and 208 extend a length that is 50% to 100% of the length of trunk portion 110, so as to provide power to a powered accessory mounted atop trunk portion 110 of tree section 106.

As described in part above, in operation, controller 120 controls groups of light sets or light elements by selectively powering any combination of conductors 204, 206, 208, or 210 to create flashing, fading, on/off or other visual effects.

As also described above, the multi-way control of light sets and tree sections is accomplished by having a tiered trunk electrical connector system, whereby the number of controllable power conductors 204-210, and the number of terminals per trunk electrical connector, decreases from a first tree section to the adjacent, then more distal tree sections. In other words, trunk electrical connectors 132 and 162 are 4-terminal connectors forming a first coupling point between tree section 102 and 104, while trunk electrical connectors 164 and 166 are 3-terminal connectors forming a second coupling point between tree sections 104 and 106. In an embodiment not including accessory power plug assembly 230, trunk electrical connectors 164 and 166 may comprise 2-terminal trunk electrical connectors.

For trees 100 having additional tree sections, or for additional control, the number of terminals of trunk electrical connectors would be increased at each junction, but would decrease for each coupling point further away from controller 120.

Referring to FIGS. 16 and 17, a single controller, 5-way controlled tree 100 is depicted. This embodiment of tree 100 is substantially similar to the 3-way tree 100 of FIG. 15, though tree 100 of FIGS. 16 and 17 allows for control over a greater number of light element groups (or other powered devices). In an embodiment, and as depicted, tree 100 includes tree sections 102, 104, and 106, and is based on a single controller configured to control five pairs of conductors corresponding to five groups of light elements. FIG. 16 is a front perspective view of three tree sections 102, 104, and 106; FIG. 17 is a left-side perspective view of tree section 102.

Referring still to FIGS. 16 and 17, tree section 102 comprises trunk portion 110, controller 120, power cord 126, trunk electrical connector 132, wire set 250 and light sets A and B.

Wire set 250 includes conductor 202, which may comprise a common ground, neutral, or negative conductor comprising one of a pair of power conductors, and multiple electrically live or positive conductors 204, 206, 208, 210 and 212. As depicted, wire set 202 includes five such positive polarity conductors, though in other embodiments, it will be understood that more or fewer such conductors may be used. Conductors 202 and 212 provide power to light set A; conductors 202 and 206 provide power to light set B.

Controller 120 is configured to selective power any combination of conductors 204, 206, 208, 210, and 212. As depicted, controller 120 may be mounted directly to trunk portion 110, and may include integral push buttons 252 for selecting light display features or programs of controller 120.

Trunk electrical connector 132 comprises a 4-terminal connector.

Tree section 104 comprises 4-terminal connector 162 and two-terminal trunk electrical connector 164. Conductors 202 and 208 provide power to light set C; conductors 202 and 210 provide power to light set D. Power for tree section 106 is transmitted via conductors 202 and 204 from connector 162 to 164.

Tree section 106 comprises trunk portion 110, 2-terminal trunk electrical connector 166, wire set 260 comprising conductors 202 and 204, and light set E. Light set E is powered by conductors 202 and 204.

As described in part above, the combination of the wiring layout and use of different types of trunk electrical connectors enables independent control of each of light sets A-E, such that various lighting displays may be created and implemented.

Figures 18, 19, 20, 21:
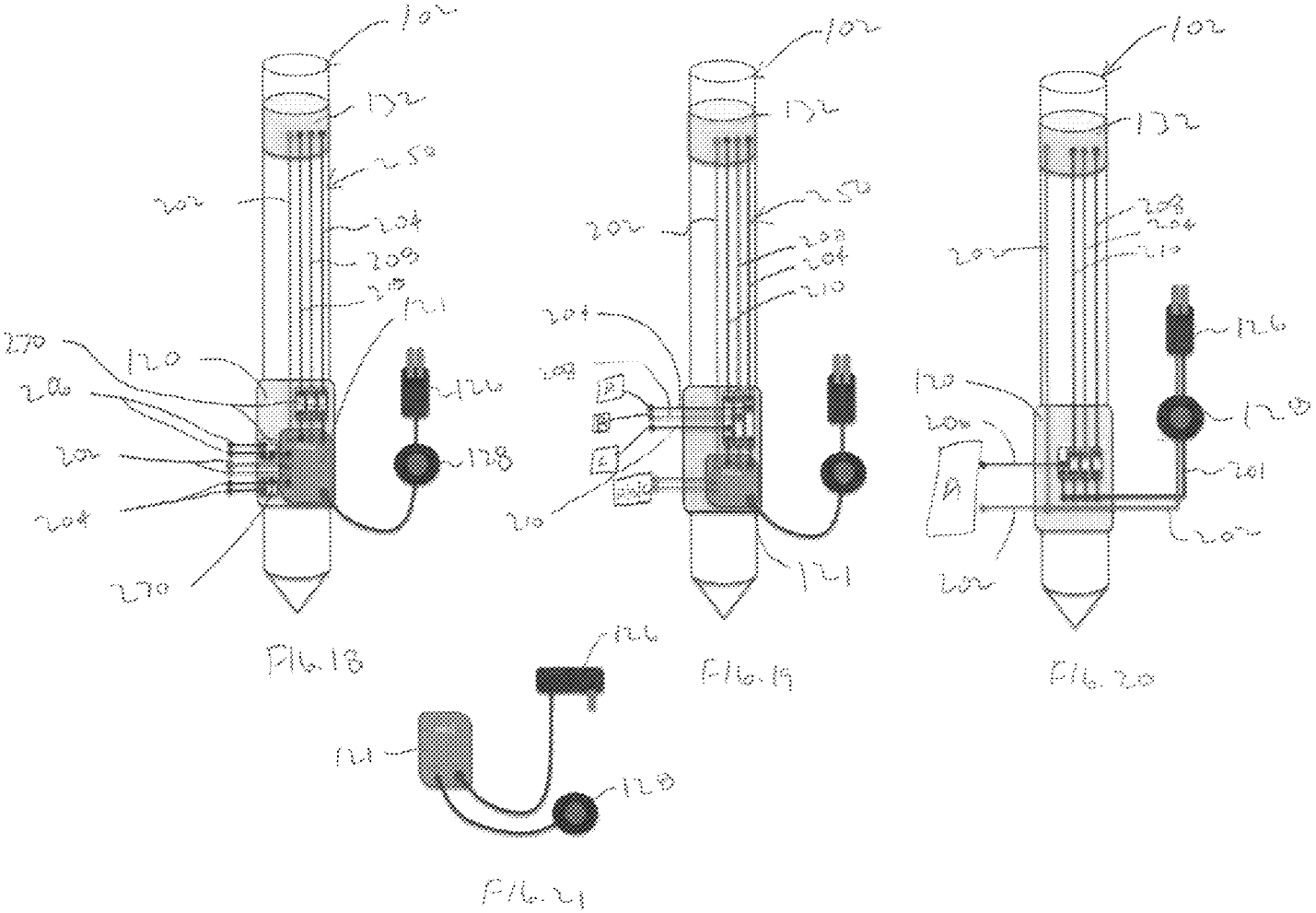
FIGS. 18-20 depict single-controller tree sections, according to embodiments.
FIG. 21 depicts a control switch and power plug connected to a controller, according to an embodiment.

Referring to FIGS. 18-20, embodiments of tree section 102 for a single controller tree 100 are depicted.

Referring specifically to FIG. 18, tree section 102 is configured for 5-way control, similar to tree section 102 as depicted in FIG. 17. FIG. 18 shows additional detail.

In this embodiment, controller 120 includes processor 121 and multiple terminal blocks 270 for electrically connecting processor 121 to conductors 202-210. Also in this embodiment, additional conductors are depicted allowing additional light sets to be powered by tree section 102.

Further, power cord 126 and control switch 128 are combined. In an embodiment, control switch 128 selectively turns power received through power cord 126 on and off.

FIG. 19 depicts another embodiment of tree section 102, and comprises controller 120 with terminal blocks 170, and wire set 280. In this configuration, controller 120 and wire set 280 are configured for 3-way operation. Tree section 102 of FIG. 19 differs from tree section 102 of FIG. 15 in that each tree section 102, 104, and 106 has each of conductors 204, 208, and 210, such that each tree section has three pairs of controllable power pairs. In such an embodiment, three light sets, such as light set A, B, and C (not depicted) may be controlled on each tree section.

Alternatively, each conductor 204, 208, and 210 can electrically connect to a multi-lamp light element, such an RGB LED, of a set of multi-lamp light elements, thereby controlling the color of the lamp.

Referring to FIG. 20, another embodiment of tree section 102 is depicted. In this embodiment, on/off control is accomplished via switch 128. Power is conducted through conductors 201 and 202. Power to a light set A, or other powered device, is transmitted or conducted through conductors 202 and 206. Conductor 201 is in electrical connection with conductors 204, 208, and 210, transmitting power over three conductors and one neutral conductor via connector 132.

FIG. 21 depicts an alternate embodiment of control switch 128 and power plug 126 connected to a processor 121. In such a configuration, processor 121 receives power from plug 126, and reacts to control signals from switch 128.

FIGS. 22-26 depict alternate embodiments of tree section 104 of a single-controller tree 100, wherein controller 120 is no longer located in tree section 102, but rather is located in tree section 104. Such a configuration allows for greater control of light sets and tree sections, as well as facilitating standard, more efficient wire layouts. As depicted, a tree configured with tree section 100 can utilize all 4-terminal conductors, yet accomplish 9-way control via nine control outputs from the processor or controller 120 controlling nine different conductors 300-316. Conductors 202 serve as a common, ground, or neutral conductors.

In this configuration, three groups of light sets on tree section 104 are powered by power conductor pairs (202, 306), (202,308), and (202, 310); three groups of conductors provide power to tree section 102: (202, 312), (202, 314), and (202, 316); and three groups of conductors provide power to tree section 106: (202, 300), (202, 302), and (202, 304).

Although nine selectively controlled conductors of a second polarity are depicted, it will be understood that the number of conductors can be more or fewer for greater or lesser control of powered light sets and devices.

As compared to placing controller 120 in the lower tree section, placing controller 120 in a middle tree section allows for greater control without having to use a great number of terminals in the trunk electrical connectors. If 9-way control was desired in a controller connected in a non-central or middle tree section, trunk electrical connector 132 would need to comprise 7 terminals, which would possibly require larger than normal trunk diameters, and could cause problems with arcing or shorting between terminals as the terminals would necessarily be placed close to one another due to the limited space.

Figure 23:
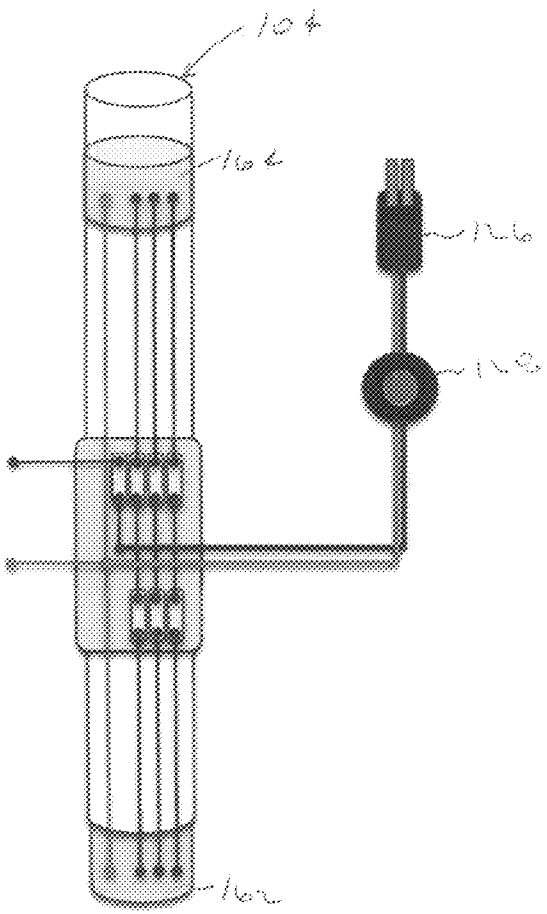

FIG. 23 depicts another embodiment of a tree section 104 having a middle hub or connector system.

Figure 22:
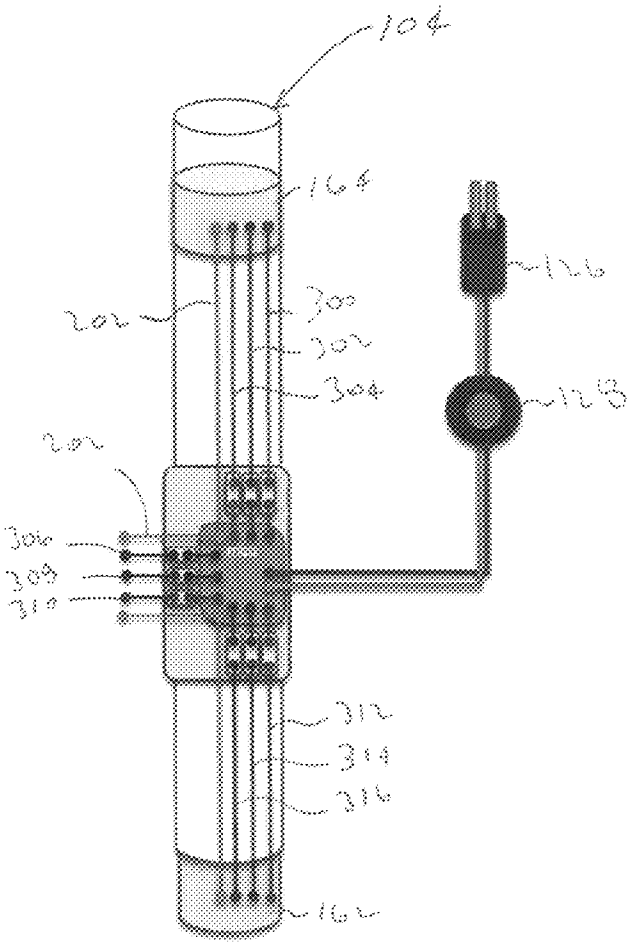
Figure 24:
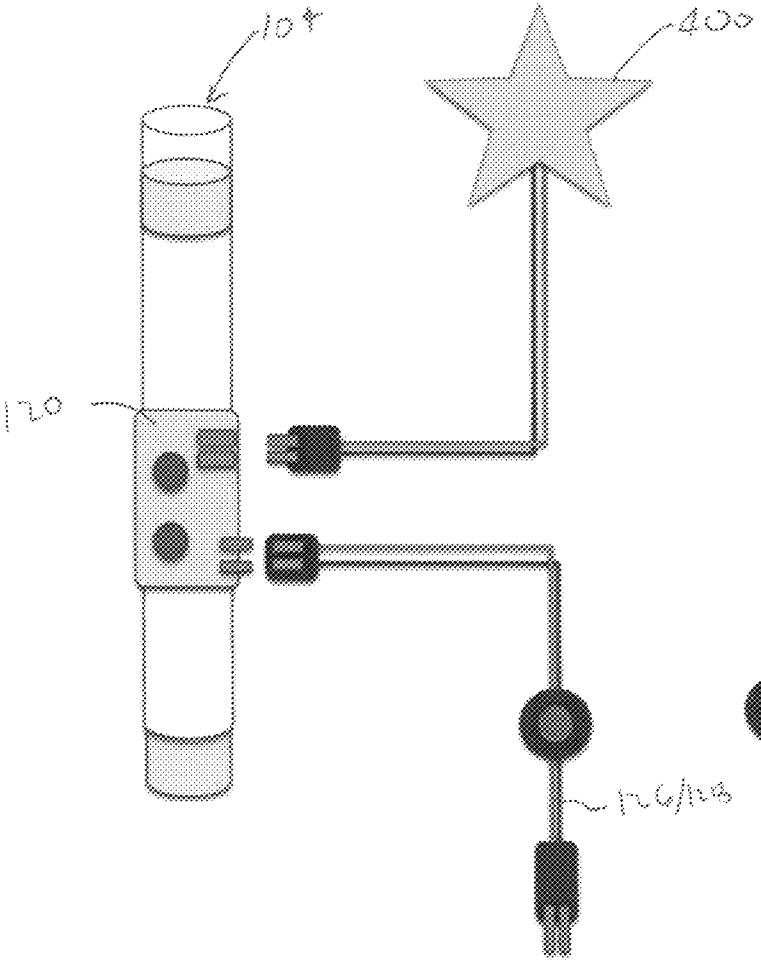

FIG. 24 depicts an embodiment of tree section 104, which may be substantially the same as tree section 104 of FIG. 22, with the addition of removable, locking, or otherwise non-integrated power plug/switch combination 126/128 and powered accessory 400. In this embodiment, optional powered accessory 400 comprises a lighted tree top ornament, and a power outlet at controller 120.

Figure 25:
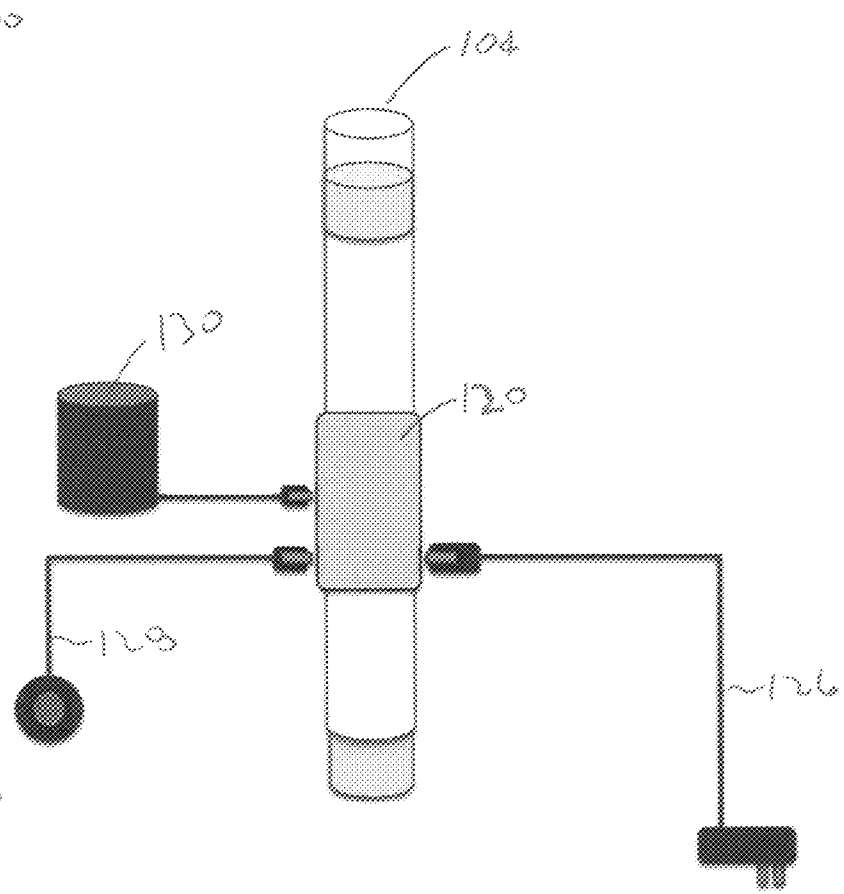

FIG. 25 depicts an embodiment of tree section 104 with optional wireless receiver 130, switch 128 and cord 126, any of which may be modular and/or detachably received by controller assembly 120.

FIG. 26 depicts tree section 104 configured for 3-way control: lights of tree section 102, 104, and 106 are controlled independent of other sections, e.g., tree section 102 may be turned on and off, faded, or otherwise controlled independent of power to other tree sections. Further, such control is accomplished via 2-terminal trunk electrical connectors 132 and 162, rather than 4-terminal connectors.

Further, controller 120 is modular and includes detachable portion 123 for receiving various embodiments of switch/power cord combination 126/128 and powered accessory 400.

Embodiments of the invention also include methods of controlling light elements of a lighted artificial tree as described herein.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. An artificial lighted tree for powering and controlling electrically powered lighting elements, comprising:

a first tree section including:

a first trunk portion;

a first plurality of branches coupled to the first trunk portion;

a first plurality of lighting elements distributed about the first plurality of branches;

a first trunk electrical connector inserted at least partially into the first trunk portion and including at least three electrical terminals for conducting power, data, or both power and data;

a first set of power wires in electrical connection with the at least three electrical terminals of the first trunk electrical connector;

a first primary controller including a processor, the first primary controller in electrical connection with the first set of power wires and the first plurality of lighting elements, and in electrical connection with at least one of the three electrical terminals of the first trunk electrical connector; and a second tree section, including:

a second trunk portion;

a second plurality of branches coupled to the second trunk portion;

a second plurality of lighting elements distributed about the second plurality of branches; and a second trunk electrical connector inserted at least partially into the second trunk portion and including at least three electrical terminals, the three electrical terminals configured to electrically connect to the three electrical terminals of the first trunk connector;

wherein the first tree section is configured to couple to the second tree section such that the first trunk electrical connector engages the second trunk electrical connector enabling power to be transmitted from the first tree section to the second tree section, and enabling data from the primary controller to be transmitted to the second tree section, and wherein the first tree section includes a first plurality of sub-controllers, each including a processor, each of the first plurality of sub-controllers in electrical communication with the first primary controller, and configured to control at least a portion of the plurality of first lighting elements.

2. The lighted artificial tree of claim 1, wherein the primary controller is coupled to an exterior portion of the first trunk portion and the first set of power wires is at least partially inside an interior cavity of the first trunk portion.

3. The lighted artificial tree of claim 2, wherein each of the plurality of sub-controllers is located external to the first trunk portion.

4. The lighted artificial tree of claim 1, further comprising a third tree section configured to couple mechanically and electrically to the first tree section such that the first tree section is between the second tree section and the third tree section when the first, second, and third trunk portions are aligned along a common vertical axis.

5. The lighted artificial tree of claim 4, wherein the first primary controller is the only primary controller.

6. The lighted artificial tree of claim 1, further comprising a receiver in electrical communication with the primary controller and for receiving wireless control signals from an external control device.

7. The lighted artificial tree of claim 6, wherein the external control device comprises a mobile telephone.

8. An artificial lighted tree for powering and controlling electrically powered lighting elements, comprising:

a first tree section including:

a first trunk portion;

a first plurality of branches coupled to the first trunk portion;

a first plurality of lighting elements distributed about the first plurality of branches;

a first trunk electrical connector inserted at least partially into the first trunk portion and including at least four electrical terminals;

a first set of power wires in electrical connection with the first trunk electrical connector;

a first controller, the first controller in electrical connection with the first set of power wires and the first plurality of lighting elements, and in electrical connection with at least one of the four electrical terminals of the first trunk electrical connector;

a first plurality of second controllers, each of the first plurality of second controllers in electrical connection with the first controller, and each of the first plurality of second controllers configured to control an individual light element of the first plurality of lighting elements; and a second tree section, including:

a second trunk portion;

a second plurality of branches coupled to the second trunk portion;

a second plurality of lighting elements distributed about the second plurality of branches;

a second trunk electrical connector inserted at least partially into the second trunk portion and including at least four electrical terminals, the four electrical terminals configured to electrically connect to the four electrical terminals of the first trunk connector; and a second plurality of second controllers, each of the second plurality of second controllers in electrical connection with the second trunk electrical connector, and each of the second plurality of second controllers configured to control an individual light element of the second plurality of lighting elements; and wherein the first tree section is configured to couple to the second tree section such that the first trunk electrical connector engages the second trunk electrical connector enabling power to be transmitted from the first tree section to the second tree section.

9. The lighted artificial tree of claim 8, wherein each light element of the plurality of first light elements is associated with a data address.

10. The lighted artificial tree of claim 8, further comprising a third tree section connectable to the second tree section, the third tree section including a third trunk electrical connector having four electrical terminals or fewer, but not less than two electrical terminals.

11. The lighted artificial tree of claim 8, further comprising a power cord configured to conduct alternating-current (AC) power, electrical circuitry configured to transform AC power to DC power, and an accessory power-plug assembly configured to provide AC power to an electrical accessory, the power cord in electrical connection with two terminals of the first trunk electrical connector for conducting AC power to the first and second tree sections and to the accessory power-plug assembly, the electrical circuitry in electrical connection to the first controller and providing DC power to the first controller and first plurality of lighting elements.

12. The lighted artificial tree of claim 8, wherein the primary controller is coupled to an exterior portion of the first trunk portion and the first set of power wires is at least partially inside an interior cavity of the first trunk portion.

13. The lighted artificial tree of claim 8, further comprising a third tree section configured to couple mechanically and electrically to the first tree section such that the first tree section is between the second tree section and the third tree section when the first, second, and third trunk portions are aligned along a common vertical axis.

14. The lighted artificial tree of claim 8, further comprising a receiver in electrical communication with the first controller and for receiving wireless control signals from an external control device.

15. The lighted artificial tree of claim 8, wherein the first plurality of lighting elements comprises a light element having multiple LEDs.

16. An artificial lighted tree for powering and controlling electrically powered lighting elements, comprising:

a first tree section including:

a first trunk portion;

a first plurality of branches coupled to the first trunk portion;

a first plurality of lighting elements distributed about the first plurality of branches, each of the lighting elements associated with a data address, and each of the lighting elements including at least two light-emitting diodes (LEDs);

a first trunk electrical connector inserted at least partially into the first trunk portion and including at least two electrical terminals;

a first set of power wires in electrical connection with the first trunk electrical connector;

a first controller, the first controller in electrical connection with the first set of power wires and the first plurality of lighting elements, and in electrical connection with at least one of the two electrical terminals of the first trunk electrical connector, the first controller configured to output an electrical signal;

a first plurality of second controllers, each of the first plurality of second controllers in electrical communication with the first controller, and each of the first plurality of second controllers configured to receive the electrical signal from the first controller and selectively power the at least two LEDs of each of the light elements of the first plurality of lighting elements based on the electrical signal and the data addresses of the lighting elements; and a second tree section, including:

a second trunk portion;

a second plurality of branches coupled to the second trunk portion;

a second plurality of lighting elements distributed about the second plurality of branches each of the lighting elements associated with a data address, and each of the lighting elements including at least two light-emitting diodes (LEDs);

a second trunk electrical connector inserted at least partially into the second trunk portion and including at least two electrical terminals, the at least two electrical terminals configured to electrically connect to the at least two electrical terminals of the first trunk connector; and a second plurality of second controllers, each of the second plurality of second controllers in electrical connection with second trunk electrical connector and each of the plurality of second controllers configured to selectively power the at least two LEDs of each of the light elements of the second plurality of lighting elements based on the electrical signal output by the first controller; and wherein the first tree section is configured to couple to the second tree section such that the first trunk electrical connector engages the second trunk electrical connector enabling power and the electrical signal to be transmitted from the first tree section to the second tree section.

17. The lighted artificial tree of claim 16, wherein the first trunk electrical connector comprises four electrical terminals, and the lighted artificial tree further comprises a power cord configured to conduct alternating-current (AC) power, electrical circuitry configured to transform AC power to DC power, and an accessory power-plug assembly configured to provide AC power to an electrical accessory, the power cord in electrical connection with a first two of the four terminals of the first trunk electrical connector for conducting AC power to the first and second tree sections and to the accessory power-plug assembly, the electrical circuitry in electrical connection to the first controller and providing DC power to the first controller and first plurality of lighting elements, and the second two of the electrical terminals of the first trunk electrical connector in electrical connection with the first controller so as to transmit the electrical signal to the first trunk electrical connector.

18. The lighted artificial tree of claim 16, wherein the primary controller is coupled to an exterior portion of the first trunk portion and the first set of power wires is at least partially inside an interior cavity of the first trunk portion.

19. The lighted artificial tree of claim 16, further comprising a third tree section configured to couple mechanically and electrically to the first tree section such that the first tree section is between the second tree section and the third tree section when the first, second, and third trunk portions are aligned along a common vertical axis.

20. The lighted artificial tree of claim 16, wherein the first controller comprises a processor, housing, and a selector switch for selecting a light function of the tree.

* * * * *